US012404756B2

(12) United States Patent
Broussard et al.

(10) Patent No.: US 12,404,756 B2
(45) Date of Patent: Sep. 2, 2025

(54) TORSIONAL COUPLING FOR ELECTRIC HYDRAULIC FRACTURING FLUID PUMPS

(71) Applicant: U.S. Well Services, LLC, Houston, TX (US)

(72) Inventors: Joel N. Broussard, Lafayette, LA (US); Jeff McPherson, Spring, TX (US); Robert Kurtz, Fairmont, WV (US); Jared Oehring, Houston, TX (US)

(73) Assignee: U.S. Well Services, LLC, Houston, TX (US)

( * ) Notice: Subject to any disclaimer, the term of this patent is extended or adjusted under 35 U.S.C. 154(b) by 0 days.

(21) Appl. No.: 18/095,197

(22) Filed: Jan. 10, 2023

(65) Prior Publication Data

US 2023/0417131 A1 Dec. 28, 2023

Related U.S. Application Data

(63) Continuation of application No. 17/379,651, filed on Jul. 19, 2021, now Pat. No. 11,549,346, which is a (Continued)

(51) Int. Cl.
*E21B 43/26* (2006.01)
*F04B 9/02* (2006.01)
(Continued)

(52) U.S. Cl.
CPC ..... *E21B 43/2607* (2020.05); *E21B 43/26* (2013.01); *F04B 9/02* (2013.01);
(Continued)

(58) Field of Classification Search
None
See application file for complete search history.

(56) References Cited

U.S. PATENT DOCUMENTS 1,656,861 A 1/1928 Leonard
1,671,436 A 5/1928 Melott
(Continued)

FOREIGN PATENT DOCUMENTS

AU 734988 9/1997
CA 2406801 11/2001
(Continued)

OTHER PUBLICATIONS

Notice of Allowance and Notice of Allowability issued in U.S. Appl. No. 15/829,419 mailed Jul. 26, 2021.
(Continued)

*Primary Examiner* — Kenneth L Thompson
(74) *Attorney, Agent, or Firm* — Abel Schillinger, LLP

(57) ABSTRACT

A system for hydraulically fracturing an underground formation in an oil or gas well, including a pump for pumping hydraulic fracturing fluid into the wellbore, the pump having a pump shaft, and an electric motor with a motor shaft mechanically attached to the pump to drive the pump. The system further includes a torsional coupling connecting the motor shaft to the pump shaft. The torsional coupling includes a motor component fixedly attached to the motor shaft and having motor coupling claws extending outwardly away from the motor shaft, and a pump component fixedly attached to the pump shaft of the pump and having pump coupling claws extending outwardly away from the pump shaft. The motor coupling claws engage with the pump coupling claws so that when the motor shaft and motor component rotate, such rotation causes the pump component and the pump shaft to rotate, thereby driving the pump.

16 Claims, 11 Drawing Sheets

Related U.S. Application Data continuation of application No. 15/581,625, filed on Apr. 28, 2017, now Pat. No. 11,066,912, which is a continuation of application No. 14/622,532, filed on Feb. 13, 2015, now Pat. No. 9,650,879, which is a continuation-in-part of application No. 13/679,689, filed on Nov. 16, 2012, now Pat. No. 9,410,410.

(51) Int. Cl.

| | |
|---|---|
| ***F04B 17/03*** | (2006.01) |
| ***F04B 47/00*** | (2006.01) |
| ***F04D 29/044*** | (2006.01) |
| ***F04D 29/66*** | (2006.01) |

(52) U.S. Cl.

CPC ..... *F04B 17/03* (2013.01); *F04B 47/00* (2013.01); *F04D 29/044* (2013.01); *F04D 29/66* (2013.01)

(56) References Cited

U.S. PATENT DOCUMENTS 2,004,077 A * 6/1935 McCartney ..... F16D 3/68 464/76
2,183,364 A 12/1939 Bailey
2,220,622 A 11/1940 Aitken
2,248,051 A 7/1941 Armstrong
2,407,796 A 9/1946 Page
2,416,848 A 3/1947 Rothery
2,610,741 A 9/1952 Schmid
2,753,940 A 7/1956 Bonner
2,976,025 A 3/1961 Pro
3,055,682 A 9/1962 Bacher
3,061,039 A 10/1962 Peters
3,066,503 A 12/1962 Fleming
3,302,069 A 1/1967 Webster
3,334,495 A 8/1967 Jensen
3,722,595 A 3/1973 Kiel
3,764,233 A 10/1973 Strickland
3,773,140 A 11/1973 Mahajan
3,837,179 A 9/1974 Barth
3,849,662 A 11/1974 Blaskowski
3,878,884 A 4/1975 Raleigh
3,881,551 A 5/1975 Terry
4,037,431 A * 7/1977 Sugimoto ..... F16D 3/68 464/73
4,100,822 A 7/1978 Rosman
4,151,575 A 4/1979 Hogue
4,172,369 A * 10/1979 Hayes ..... F16D 3/68 464/73
4,226,299 A 10/1980 Hansen
4,265,266 A 5/1981 Kierbow et al.
4,411,313 A 10/1983 Johnson et al.
4,432,064 A 2/1984 Barker
4,442,665 A 4/1984 Fick et al.
4,456,092 A 6/1984 Kubozuka
4,506,982 A 3/1985 Smithers et al.
4,512,387 A 4/1985 Rodriguez
4,529,887 A 7/1985 Johnson
4,538,916 A 9/1985 Zimmerman
4,601,629 A 7/1986 Zimmerman
4,676,063 A 6/1987 Goebel et al.
4,759,674 A 7/1988 Schroder
4,768,884 A 9/1988 Elkin
4,793,386 A 12/1988 Sloan
4,845,981 A 7/1989 Pearson
4,922,463 A 5/1990 Del Zotto et al.
5,004,400 A 4/1991 Handke
5,006,044 A 4/1991 Walker, Sr.
5,025,861 A 6/1991 Huber et al.
5,050,673 A 9/1991 Baldridge
5,130,628 A 7/1992 Owen
5,131,472 A 7/1992 Dees et al.
5,172,009 A 12/1992 Mohan
5,189,388 A 2/1993 Mosley
5,230,366 A 7/1993 Marandi
5,334,899 A 8/1994 Skybyk
5,366,324 A 11/1994 Arlt
5,422,550 A 6/1995 McClanahan
5,433,243 A 7/1995 Griswold
5,439,066 A 8/1995 Gipson
5,486,047 A 1/1996 Zimmerman
5,491,098 A 2/1996 Noppe
5,517,822 A 5/1996 Haws et al.
5,548,093 A 8/1996 Sato
5,590,976 A 1/1997 Kilheffer et al.
5,655,361 A 8/1997 Kishi
5,736,838 A 4/1998 Dove et al.
5,755,096 A 5/1998 Holleyman
5,790,972 A 8/1998 Kohlenberger
5,798,596 A 8/1998 Lordo
5,813,455 A 9/1998 Pratt et al.
5,865,247 A 2/1999 Paterson
5,879,137 A 3/1999 Yie
5,894,888 A 4/1999 Wiemers
5,907,970 A * 6/1999 Havlovick ..... F02B 63/00 403/3
6,035,265 A 3/2000 Dister et al.
6,097,310 A 8/2000 Harrell et al.
6,121,705 A 9/2000 Hoong
6,138,764 A 10/2000 Scarsdale et al.
6,142,878 A 11/2000 Barin
6,164,910 A 12/2000 Mayleben
6,202,702 B1 3/2001 Ohira
6,208,098 B1 3/2001 Kume
6,254,462 B1 7/2001 Kelton
6,271,637 B1 8/2001 Kushion
6,273,193 B1 8/2001 Hermann et al.
6,315,523 B1 11/2001 Mills
6,442,942 B1 9/2002 Kopko
6,477,852 B2 11/2002 Dodo
6,484,490 B1 11/2002 Olsen
6,529,135 B1 3/2003 Bowers et al.
6,560,131 B1 5/2003 VonBrethorst
6,585,455 B1 7/2003 Petersen et al.
6,626,646 B2 9/2003 Rajewski
6,719,900 B2 4/2004 Hawkins
6,765,304 B2 7/2004 Baten et al.
6,776,227 B2 8/2004 Beida
6,788,022 B2 9/2004 Sopko
6,802,690 B2 10/2004 Han
6,808,303 B2 10/2004 Fisher
6,931,310 B2 8/2005 Shimizu et al.
6,936,947 B1 8/2005 Leijon
6,985,750 B1 1/2006 Vicknair et al.
7,082,993 B2 8/2006 Ayoub
7,104,233 B2 9/2006 Ryczek et al.
7,170,262 B2 1/2007 Pettigrew
7,173,399 B2 2/2007 Sihler
7,308,933 B1 12/2007 Mayfield
7,312,593 B1 12/2007 Streicher et al.
7,336,514 B2 2/2008 Amarillas
7,445,041 B2 11/2008 O'Brien
7,494,263 B2 2/2009 Dykstra et al.
7,500,642 B2 3/2009 Cunningham
7,525,264 B2 4/2009 Dodge
7,563,076 B2 7/2009 Brunet
7,581,379 B2 9/2009 Yoshida
7,675,189 B2 3/2010 Grenier
7,683,499 B2 3/2010 Saucier
7,717,193 B2 5/2010 Egilsson et al.
7,755,310 B2 7/2010 West et al.
7,795,830 B2 9/2010 Johnson
7,807,048 B2 10/2010 Collette
7,835,140 B2 11/2010 Mori
7,845,413 B2 12/2010 Shampine et al.
7,926,562 B2 4/2011 Poitzsch
7,977,824 B2 7/2011 Halen et al.
7,984,757 B1 7/2011 Keast
8,037,936 B2 10/2011 Neuroth
8,054,084 B2 11/2011 Schulz et al.
8,083,504 B2 12/2011 Williams
8,091,928 B2 1/2012 Carrier

(56) References Cited

U.S. PATENT DOCUMENTS 8,096,354 B2 1/2012 Poitzsch
8,096,891 B2 1/2012 Lochtefeld
8,139,383 B2 3/2012 Efraimsson
8,146,665 B2 4/2012 Neal
8,154,419 B2 4/2012 Daussin et al.
8,232,892 B2 7/2012 Overholt et al.
8,261,528 B2 9/2012 Chillar
8,272,439 B2 9/2012 Strickland
8,310,272 B2 11/2012 Quarto
8,354,817 B2 1/2013 Yeh et al.
8,474,521 B2 7/2013 Kajaria
8,506,267 B2 8/2013 Gambier et al.
8,534,235 B2 9/2013 Chandler
8,573,303 B2 11/2013 Kerfoot
8,596,056 B2 12/2013 Woodmansee
8,616,005 B1 12/2013 Cousino
8,616,274 B2 12/2013 Belcher et al.
8,646,521 B2 2/2014 Bowen
8,650,879 B2 2/2014 Freund et al.
8,692,408 B2 4/2014 Zhang et al.
8,727,068 B2 5/2014 Bruin
8,760,657 B2 6/2014 Pope
8,763,387 B2 7/2014 Schmidt
8,774,972 B2 7/2014 Rusnak et al.
8,789,601 B2 7/2014 Broussard
8,795,525 B2 8/2014 McGinnis et al.
8,800,652 B2 8/2014 Bartko
8,807,960 B2 8/2014 Stephenson
8,838,341 B2 9/2014 Kumano
8,851,860 B1 10/2014 Mail
8,857,506 B2 10/2014 Stone, Jr
8,899,940 B2 12/2014 Laugemors
8,905,056 B2 12/2014 Kendrick
8,905,138 B2 12/2014 Lundstedt et al.
8,997,904 B2 4/2015 Cryer
9,018,881 B2 4/2015 Mao et al.
9,051,822 B2 6/2015 Ayan
9,051,923 B2 6/2015 Kuo
9,061,223 B2 6/2015 Winborn
9,062,545 B2 6/2015 Roberts et al.
9,067,182 B2 6/2015 Nichols
9,103,193 B2 8/2015 Coli
9,119,326 B2 8/2015 McDonnell
9,121,257 B2 9/2015 Coli et al.
9,140,105 B2 9/2015 Pattillo
9,140,110 B2 9/2015 Coli et al.
9,160,168 B2 10/2015 Chapel
9,175,554 B1 11/2015 Watson
9,206,684 B2 12/2015 Parra
9,260,253 B2 2/2016 Naizer
9,322,239 B2 4/2016 Angeles Boza et al.
9,324,049 B2 4/2016 Thomeer
9,340,353 B2 5/2016 Oren
9,353,593 B1 5/2016 Lu et al.
9,366,114 B2 6/2016 Coli et al.
9,395,049 B2 * 7/2016 Vicknair ..... F17D 1/08
9,410,410 B2 8/2016 Broussard et al.
9,450,385 B2 9/2016 Kristensen
9,456,540 B2 * 10/2016 Rees ..... F16D 11/08
9,458,687 B2 10/2016 Hallundbaek
9,475,020 B2 10/2016 Coli et al.
9,475,021 B2 10/2016 Coli et al.
9,482,086 B2 11/2016 Richardson et al.
9,499,335 B2 11/2016 McIver
9,506,333 B2 11/2016 Castillo et al.
9,513,055 B1 12/2016 Seal
9,534,473 B2 1/2017 Morris et al.
9,562,420 B2 2/2017 Morris et al.
9,587,649 B2 3/2017 Oehring
9,611,728 B2 4/2017 Oehring
9,650,879 B2 * 5/2017 Broussard ..... E21B 43/2607
9,706,185 B2 7/2017 Ellis
9,728,354 B2 8/2017 Skolozdra
9,738,461 B2 8/2017 DeGaray
9,739,546 B2 8/2017 Bertilsson et al.
9,745,840 B2 8/2017 Oehring et al.
9,790,858 B2 10/2017 Kanebako
9,863,228 B2 1/2018 Shampine et al.
9,909,398 B2 3/2018 Pham
9,915,128 B2 3/2018 Hunter
9,932,799 B2 4/2018 Symchuk
9,945,365 B2 * 4/2018 Hernandez ..... F04B 47/02
9,963,961 B2 5/2018 Hardin
9,976,351 B2 5/2018 Randall
10,008,880 B2 6/2018 Vicknair
10,184,465 B2 1/2019 Enis et al.
10,196,878 B2 2/2019 Hunter
10,221,639 B2 3/2019 Romer et al.
10,227,854 B2 3/2019 Glass
10,232,332 B2 3/2019 Oehring
10,246,984 B2 4/2019 Payne
10,254,732 B2 4/2019 Oehring
10,260,327 B2 4/2019 Kajaria
10,280,724 B2 5/2019 Hinderliter
10,287,873 B2 5/2019 Filas
10,302,079 B2 5/2019 Kendrick
10,309,205 B2 6/2019 Randall
10,337,308 B2 7/2019 Broussard
10,371,012 B2 8/2019 Davis
10,378,326 B2 8/2019 Morris
10,393,108 B2 8/2019 Chong
10,407,990 B2 9/2019 Oehring
10,408,030 B2 9/2019 Oehring et al.
10,408,031 B2 9/2019 Oehring et al.
10,415,332 B2 9/2019 Morris et al.
10,436,026 B2 10/2019 Ounadjela
10,627,003 B2 4/2020 Dale et al.
10,648,270 B2 5/2020 Brunty et al.
10,648,311 B2 5/2020 Oehring et al.
10,669,471 B2 6/2020 Schmidt et al.
10,669,804 B2 6/2020 Kotrla
10,686,301 B2 6/2020 Oehring et al.
10,695,950 B2 6/2020 Igo et al.
10,711,576 B2 7/2020 Bishop
10,731,561 B2 8/2020 Oehring et al.
10,740,730 B2 8/2020 Altamirano et al.
10,767,561 B2 9/2020 Brady
10,781,752 B2 9/2020 Kikkawa et al.
10,794,165 B2 10/2020 Fischer et al.
10,988,998 B2 4/2021 Fischer et al.
11,066,912 B2 * 7/2021 Broussard ..... E21B 43/26
11,549,346 B2 * 1/2023 Broussard ..... F04D 29/66
2002/0169523 A1 11/2002 Ross
2003/0000759 A1 1/2003 Schmitz
2003/0056514 A1 3/2003 Lohn
2003/0079875 A1 5/2003 Weng
2003/0138327 A1 7/2003 Jones et al.
2004/0040746 A1 3/2004 Niedemayr
2004/0045703 A1 3/2004 Hooper et al.
2004/0102109 A1 5/2004 Cratty
2004/0167738 A1 8/2004 Miller
2005/0061548 A1 3/2005 Hooper
2005/0116542 A1 6/2005 Seiver
2005/0274508 A1 12/2005 Folk
2006/0052903 A1 3/2006 Bassett
2006/0065319 A1 3/2006 Csitari
2006/0260331 A1 11/2006 Andreychuk
2007/0131410 A1 6/2007 Hill
2007/0187163 A1 8/2007 Cone
2007/0201305 A1 8/2007 Heilman et al.
2007/0226089 A1 9/2007 DeGaray et al.
2007/0277982 A1 12/2007 Shampine
2007/0278140 A1 12/2007 Mallet et al.
2008/0017369 A1 1/2008 Sarada
2008/0041596 A1 2/2008 Blount
2008/0095644 A1 4/2008 Mantei et al.
2008/0112802 A1 5/2008 Orlando
2008/0137266 A1 6/2008 Jensen
2008/0208478 A1 8/2008 Ella et al.
2008/0217024 A1 9/2008 Moore
2008/0236818 A1 10/2008 Dykstra
2008/0264625 A1 10/2008 Ochoa
2008/0264640 A1 10/2008 Eslinger
2008/0264649 A1 10/2008 Crawford

(56) References Cited

U.S. PATENT DOCUMENTS

2008/0277120 A1 11/2008 Hickie
2009/0045782 A1 2/2009 Datta
2009/0065299 A1 3/2009 Vito
2009/0072645 A1 3/2009 Quere
2009/0078410 A1 3/2009 Krenek et al.
2009/0090504 A1 4/2009 Weightman
2009/0093317 A1 4/2009 Kajiwara et al.
2009/0095482 A1 4/2009 Surjaatmadja
2009/0145611 A1 6/2009 Pallini, Jr.
2009/0153354 A1 6/2009 Daussin et al.
2009/0188181 A1 7/2009 Forbis
2009/0200035 A1 8/2009 Bjerkreim et al.
2009/0260826 A1 10/2009 Sherwood
2009/0308602 A1 12/2009 Bruins et al.
2010/0000508 A1 1/2010 Chandler
2010/0019574 A1 1/2010 Baldassarre
2010/0038907 A1 2/2010 Hunt
2010/0045109 A1 2/2010 Arnold
2010/0051272 A1 3/2010 Loree et al.
2010/0101785 A1 4/2010 Khvoshchev
2010/0132949 A1 6/2010 DeFosse et al.
2010/0146981 A1 6/2010 Motakef
2010/0172202 A1 7/2010 Borgstadt
2010/0200224 A1 8/2010 Nguete
2010/0250139 A1 9/2010 Hobbs et al.
2010/0293973 A1 11/2010 Erickson
2010/0303655 A1 12/2010 Scekic
2010/0322802 A1 12/2010 Kugelev
2011/0005757 A1 1/2011 Hebert
2011/0017468 A1 1/2011 Birch et al.
2011/0052423 A1 3/2011 Gambier et al.
2011/0061855 A1 3/2011 Case et al.
2011/0085924 A1* 4/2011 Shampine ..... F16F 15/1407 188/379
2011/0110793 A1 5/2011 Leugemors et al.
2011/0166046 A1 7/2011 Weaver
2011/0247878 A1 10/2011 Rasheed
2011/0272158 A1 11/2011 Neal
2012/0018016 A1 1/2012 Gibson
2012/0049625 A1 3/2012 Hopwood
2012/0085541 A1 4/2012 Love et al.
2012/0112757 A1 5/2012 Vrankovic et al.
2012/0127635 A1 5/2012 Grindeland
2012/0152716 A1 6/2012 Kikukawa et al.
2012/0205301 A1 8/2012 McGuire et al.
2012/0205400 A1 8/2012 DeGaray et al.
2012/0222865 A1 9/2012 Larson
2012/0232728 A1 9/2012 Karimi
2012/0247783 A1 10/2012 Berner, Jr
2012/0255734 A1 10/2012 Coli et al.
2013/0009469 A1 1/2013 Gillett
2013/0025706 A1 1/2013 DeGaray et al.
2013/0051971 A1 2/2013 Wyse et al.
2013/0175038 A1 7/2013 Conrad
2013/0175039 A1 7/2013 Guidry
2013/0180722 A1 7/2013 Olarte Caro et al.
2013/0189629 A1 7/2013 Chandler
2013/0199617 A1 8/2013 DeGaray et al.
2013/0233542 A1 9/2013 Shampine
2013/0255271 A1 10/2013 Yu et al.
2013/0284278 A1 10/2013 Winborn
2013/0284455 A1 10/2013 Kajaria et al.
2013/0299167 A1 11/2013 Fordyce et al.
2013/0306322 A1 11/2013 Sanborn et al.
2013/0317750 A1 11/2013 Hunter
2013/0341029 A1 12/2013 Roberts et al.
2013/0343858 A1 12/2013 Flusche
2014/0000899 A1 1/2014 Nevison
2014/0010671 A1* 1/2014 Cryer ..... B60K 6/485 290/45
2014/0054965 A1 2/2014 Jain
2014/0060658 A1 3/2014 Hains
2014/0095114 A1 4/2014 Thomeer
2014/0096974 A1 4/2014 Coli
2014/0124162 A1 5/2014 Leavitt
2014/0138079 A1 5/2014 Broussard
2014/0174691 A1 6/2014 Kamps
2014/0174717 A1 6/2014 Broussard et al.
2014/0219824 A1 8/2014 Burnette
2014/0238683 A1 8/2014 Korach
2014/0246211 A1 9/2014 Guidry
2014/0251623 A1 9/2014 Lestz et al.
2014/0255214 A1 9/2014 Burnette
2014/0277772 A1 9/2014 Lopez
2014/0290768 A1 10/2014 Randle
2014/0379300 A1 12/2014 Devine et al.
2015/0027712 A1 1/2015 Vicknair
2015/0053426 A1 2/2015 Smith
2015/0068724 A1 3/2015 Coli et al.
2015/0068754 A1 3/2015 Coli et al.
2015/0075778 A1 3/2015 Walters
2015/0083426 A1 3/2015 Lesko
2015/0097504 A1 4/2015 Lamascus
2015/0114652 A1 4/2015 Lestz
2015/0136043 A1 5/2015 Shaaban
2015/0144336 A1 5/2015 Hardin et al.
2015/0159911 A1 6/2015 Holt
2015/0175013 A1 6/2015 Cryer et al.
2015/0176386 A1 6/2015 Castillo et al.
2015/0211512 A1 7/2015 Wiegman
2015/0211524 A1 7/2015 Broussard
2015/0217672 A1 8/2015 Shampine
2015/0225113 A1 8/2015 Lungu
2015/0252661 A1 9/2015 Glass
2015/0300145 A1 10/2015 Coli et al.
2015/0300336 A1 10/2015 Hernandez et al.
2015/0314225 A1 11/2015 Coli et al.
2015/0330172 A1 11/2015 Allmaras
2015/0354322 A1 12/2015 Vicknair
2016/0006311 A1 1/2016 Li
2016/0032703 A1 2/2016 Broussard et al.
2016/0102537 A1 4/2016 Lopez
2016/0105022 A1 4/2016 Oehring
2016/0160889 A1 6/2016 Hoffman et al.
2016/0177675 A1 6/2016 Morris et al.
2016/0177678 A1 6/2016 Morris
2016/0186531 A1 6/2016 Harkless et al.
2016/0208592 A1 7/2016 Oehring
2016/0208593 A1 7/2016 Coli et al.
2016/0208594 A1 7/2016 Coli et al.
2016/0208595 A1 7/2016 Tang
2016/0221220 A1 8/2016 Paige
2016/0230524 A1 8/2016 Dumoit
2016/0230525 A1 8/2016 Lestz et al.
2016/0230660 A1 8/2016 Zeitoun et al.
2016/0258267 A1 9/2016 Payne et al.
2016/0265457 A1 9/2016 Stephenson
2016/0273328 A1 9/2016 Oehring
2016/0273456 A1 9/2016 Zhang et al.
2016/0281484 A1 9/2016 Lestz
2016/0290114 A1 10/2016 Oehring
2016/0290563 A1 10/2016 Diggins
2016/0312108 A1 10/2016 Lestz et al.
2016/0319650 A1 11/2016 Oehring
2016/0326853 A1 11/2016 Fred et al.
2016/0326854 A1 11/2016 Broussard
2016/0326855 A1 11/2016 Coli et al.
2016/0341281 A1 11/2016 Brunvold et al.
2016/0348479 A1 12/2016 Oehring
2016/0349728 A1 12/2016 Oehring
2016/0369609 A1 12/2016 Morris et al.
2017/0016433 A1 1/2017 Chong
2017/0021318 A1 1/2017 McIver et al.
2017/0022788 A1 1/2017 Oehring et al.
2017/0022807 A1 1/2017 Dursun
2017/0028368 A1 2/2017 Oehring et al.
2017/0030177 A1 2/2017 Oehring et al.
2017/0030178 A1 2/2017 Oehring et al.
2017/0036178 A1 2/2017 Coli et al.
2017/0036872 A1 2/2017 Wallace
2017/0037717 A1 2/2017 Oehring
2017/0037718 A1 2/2017 Coli et al.
2017/0043280 A1 2/2017 Vankouwenberg
2017/0051732 A1 2/2017 Hernandez et al.

(56) References Cited

U.S. PATENT DOCUMENTS

| | | | |
|---|---|---|---|
| 2017/0074076 | A1 | 3/2017 | Joseph et al. |
| 2017/0082033 | A1 | 3/2017 | Wu et al. |
| 2017/0089189 | A1 | 3/2017 | Norris et al. |
| 2017/0096885 | A1 | 4/2017 | Oehring |
| 2017/0104389 | A1 | 4/2017 | Morris et al. |
| 2017/0114625 | A1 | 4/2017 | Norris |
| 2017/0130743 | A1 | 5/2017 | Anderson |
| 2017/0138171 | A1 | 5/2017 | Richards et al. |
| 2017/0146189 | A1 | 5/2017 | Herman |
| 2017/0159570 | A1 | 6/2017 | Bickert |
| 2017/0159654 | A1 | 6/2017 | Kendrick |
| 2017/0175516 | A1 | 6/2017 | Eslinger |
| 2017/0212535 | A1 | 7/2017 | Shelman et al. |
| 2017/0218727 | A1 | 8/2017 | Oehring |
| 2017/0218843 | A1 | 8/2017 | Oehring et al. |
| 2017/0222409 | A1 | 8/2017 | Oehring et al. |
| 2017/0226838 | A1 | 8/2017 | Ceizobka et al. |
| 2017/0226842 | A1 | 8/2017 | Omont et al. |
| 2017/0234250 | A1 | 8/2017 | Janik |
| 2017/0241221 | A1 | 8/2017 | Seshadri |
| 2017/0259227 | A1 | 9/2017 | Morris et al. |
| 2017/0292513 | A1 | 10/2017 | Haddad |
| 2017/0302218 | A1 | 10/2017 | Janik |
| 2017/0313499 | A1 | 11/2017 | Hughes et al. |
| 2017/0314380 | A1 | 11/2017 | Oehring |
| 2017/0314979 | A1 | 11/2017 | Ye et al. |
| 2017/0328179 | A1 | 11/2017 | Dykstra |
| 2017/0369258 | A1 | 12/2017 | DeGaray |
| 2017/0370639 | A1 | 12/2017 | Barden et al. |
| 2018/0028992 | A1 | 2/2018 | Stegemoeller |
| 2018/0038216 | A1 | 2/2018 | Zhang |
| 2018/0045331 | A1 | 2/2018 | Lopez |
| 2018/0090914 | A1 | 3/2018 | Johnson et al. |
| 2018/0181830 | A1 | 6/2018 | Laharuka et al. |
| 2018/0216455 | A1 | 8/2018 | Andreychuk |
| 2018/0238147 | A1 | 8/2018 | Shahri |
| 2018/0245428 | A1 | 8/2018 | Richards |
| 2018/0259080 | A1 | 9/2018 | Dale et al. |
| 2018/0266217 | A1 | 9/2018 | Funkhauser et al. |
| 2018/0266412 | A1 | 9/2018 | Stokkevag |
| 2018/0284817 | A1 | 10/2018 | Cook et al. |
| 2018/0291713 | A1 | 10/2018 | Jeanson |
| 2018/0298731 | A1 | 10/2018 | Bishop |
| 2018/0312738 | A1 | 11/2018 | Rutsch et al. |
| 2018/0320483 | A1 | 11/2018 | Zhang |
| 2018/0343125 | A1 | 11/2018 | Clish |
| 2018/0363437 | A1 | 12/2018 | Coli et al. |
| 2018/0363640 | A1 | 12/2018 | Kajita et al. |
| 2018/0366950 | A1 | 12/2018 | Pedersen et al. |
| 2019/0003329 | A1 | 1/2019 | Morris |
| 2019/0010793 | A1 | 1/2019 | Hinderliter |
| 2019/0063309 | A1 | 2/2019 | Davis |
| 2019/0100989 | A1 | 4/2019 | Stewart |
| 2019/0112910 | A1 | 4/2019 | Oehring |
| 2019/0119096 | A1 | 4/2019 | Haile |
| 2019/0120024 | A1 | 4/2019 | Oehring |
| 2019/0128080 | A1 | 5/2019 | Ross |
| 2019/0154020 | A1 | 5/2019 | Glass |
| 2019/0162061 | A1 | 5/2019 | Stephenson |
| 2019/0169971 | A1 | 6/2019 | Oehring |
| 2019/0178057 | A1 | 6/2019 | Hunter |
| 2019/0178235 | A1 | 6/2019 | Coskrey |
| 2019/0203567 | A1 | 7/2019 | Ross |
| 2019/0203572 | A1 | 7/2019 | Morris |
| 2019/0211661 | A1 | 7/2019 | Reckels |
| 2019/0226317 | A1 | 7/2019 | Payne |
| 2019/0245348 | A1 | 8/2019 | Hinderliter |
| 2019/0249527 | A1 | 8/2019 | Kraynek |
| 2019/0292866 | A1 | 9/2019 | Ross |
| 2019/0292891 | A1 | 9/2019 | Kajaria |
| 2019/0316447 | A1 | 10/2019 | Oehring |
| 2020/0040878 | A1 | 2/2020 | Morris |
| 2020/0047141 | A1 | 2/2020 | Oehring et al. |
| 2020/0088152 | A1 | 3/2020 | Allion et al. |
| 2020/0232454 | A1 | 7/2020 | Chretien |
| 2020/0325760 | A1 | 10/2020 | Markham |
| 2020/0350790 | A1 | 11/2020 | Luft et al. |

FOREIGN PATENT DOCUMENTS

| | | | |
|---|---|---|---|
| CA | 2707269 | | 12/2010 |
| CA | 2482943 | | 5/2011 |
| CA | 3050131 | | 11/2011 |
| CA | 2955706 | | 10/2012 |
| CA | 2966672 | | 10/2012 |
| CA | 3000322 | | 4/2013 |
| CA | 2787814 | | 2/2014 |
| CA | 2833711 | | 5/2014 |
| CA | 2978706 | | 9/2016 |
| CA | 2944980 | | 2/2017 |
| CA | 3006422 | | 6/2017 |
| CA | 3018485 | | 8/2017 |
| CA | 2964593 | | 10/2017 |
| CA | 2849825 | | 7/2018 |
| CA | 3067854 | A1 | 1/2019 |
| CA | 2919649 | | 2/2019 |
| CA | 2919666 | | 7/2019 |
| CA | 2797081 | | 9/2019 |
| CA | 2945579 | | 10/2019 |
| CN | 201687513 | | 12/2010 |
| CN | 101977016 | | 2/2011 |
| CN | 202023547 | | 11/2011 |
| CN | 102602322 | | 7/2012 |
| CN | 104196613 | A1 | 12/2014 |
| CN | 205986303 | U | 2/2017 |
| CN | 108049999 | A1 | 5/2018 |
| JP | 2004264589 | | 9/2004 |
| WO | 2008081368 | A1 | 7/2008 |
| WO | 2009046280 | | 4/2009 |
| WO | 2014177346 | | 11/2014 |
| WO | 2016/144939 | | 9/2016 |
| WO | 2016/160458 | | 10/2016 |
| WO | 2018044307 | A1 | 3/2018 |
| WO | 2018213925 | A1 | 11/2018 |
| WO | 2019210417 | | 11/2019 |

OTHER PUBLICATIONS

Notice of Allowance issued in corresponding U.S. Appl. No. 14/622,532 dated Mar. 27, 2017.

Notice of Allowance issued in corresponding U.S. Appl. No. 15/217,040 dated Mar. 28, 2017.

Notice of Allowance mailed Apr. 23, 2019 in corresponding U.S. Appl. No. 15/635,028.

Notice of Allowance mailed Jan. 9, 2020 in related U.S. Appl. No. 16/570,331.

Office Action dated Apr. 10, 2018 in related U.S. Appl. No. 15/294,349.

Office Action dated Apr. 2, 2018 in related U.S. Appl. No. 15/183,387.

Office Action dated May 29, 2018 in related U.S. Appl. No. 15/235,716.

Office Action mailed Aug. 19, 2019 in related U.S. Appl. No. 15/356,436.

Office Action mailed Aug. 4, 2020 in related U.S. Appl. No. 16/385,070.

Office Action mailed Dec. 12, 2018 in related U.S. Appl. No. 16/160,708.

Office Action mailed Jan. 30, 2019 in related Canadian Patent Application No. 2,936,997.

Office Action mailed Jul. 25, 2018 in related U.S. Appl. No. 15/644,487.

Office Action mailed Jun. 11, 2019 in corresponding U.S. Appl. No. 16/210,749.

Office Action mailed Jun. 29, 2020 in related U.S. Appl. No. 16/404,283.

Office Action mailed Jun. 29, 2020 in related U.S. Appl. No. 16/728,359.

Office Action mailed Jun. 7, 2019 in corresponding U.S. Appl. No. 16/170,695.

(56) References Cited

OTHER PUBLICATIONS

Office Action mailed Mar. 1, 2019 in related Canadian Patent Application No. 2,943,275.
Office Action mailed May 10, 2019 in corresponding U.S. Appl. No. 16/268,030.
Office Action mailed Oct. 11, 2019 in related U.S. Appl. No. 16/385,070.
Office Action mailed Oct. 2, 2019 in related U.S. Appl. No. 16/152,732.
Office Action mailed Sep. 11, 2019 in related U.S. Appl. No. 16/268,030.
Office Action mailed Sep. 20, 2019 in related U.S. Appl. No. 16/443,273.
Office Action mailed Sep. 3, 2019 in related U.S. Appl. No. 15/994,772.
Schlumberger, "Jet Manual 23, Fracturing Pump Units, SPF/SPS-343, Version 1.0," Jan. 31, 2007, 68 pages.
Stewart & Stevenson, "Stimulation Systems," 2007, 20 pages.
UK Power Networks—Transformers to Supply Heat to Tate Modern—from Press Releases May 16, 2013.
Woodbury et al., "Electrical Design Considerations for Drilling Rigs," IEEE Transactions on Industry Applications, vol. 1A-12, No. 4, Jul./Aug. 1976, pp. 421-431.
International Search Report and Written Opinion mailed Nov. 26, 2019 in related PCT Application No. PCT/US19/51018.
International Search Report and Written Opinion mailed Sep. 11, 2019 in related PCT Application No. PCT/US2019/037493.
International Search Report and Written Opinion Mailed Sep. 3, 2020 in PCT/US2020/36932.
Karim, "Duel Fuel Diesel Engines," (2015), Taylor & Francis, pp. 62-63, Retrieved from https://app.knovel.com/hotlink/oc/id:kpDFDE0001/dual-fueal-diesel-engines/duel-fuel-diesel-engines (Year 2015).
Luis Gamboa, "Variable Frequency Drives in Oil and Gas Pumping Systems," Dec. 17, 2011, 5 pages.
Morris et al., U.S. Appl. No. 62/526,869; Hydration-Blender Transport and Electric Power Distribution for Fracturing Operation; Jun. 28, 2018; USPTO; see entire document.
Non-Final Office Action mailed Mar. 3, 2020 in U.S. Appl. No. 16/152,695.
Non-Final Office Action dated Oct. 4, 2018 in related U.S. Appl. No. 15/217,081.
Non-Final Office Action issued in corresponding U.S. Appl. No. 14/622,532 dated Aug. 5, 2015.
Non-Final Office Action issued in corresponding U.S. Appl. No. 14/622,532 dated May 17, 2016.
Non-Final Office Action issued in corresponding U.S. Appl. No. 14/884,363 dated Sep. 5, 2017.
Office Action issued in corresponding U.S. Appl. No. 15/145,443 dated Feb. 7, 2017.
Office Action issued in Corresponding U.S. Appl. No. 15/145,491 on May 15, 2017.
Office Action issued in corresponding U.S. Appl. No. 15/145,491 on Sep. 12, 2016.
Office Action issued in corresponding U.S. Appl. No. 15/217,040 dated Nov. 29, 2016.
Office Action issued in corresponding U.S. Appl. No. 15/235,788 dated Dec. 14, 2016.
Office Action issued in corresponding U.S. Appl. No. 15/291,842 dated Jan. 6, 2017.
Office Action issued in corresponding U.S. Appl. No. 15/293,681 dated Feb. 16, 2017.
In corresponding U.S. Appl. No. 15/294,349 dated Mar. 14, 2017.
In corresponding U.S. Appl. No. 15/486,970 dated Jun. 22, 2017.
Non-Final Office Action issued in corresponding U.S. Appl. No. 15/487,656 dated Jun. 23, 2017.
Non-Final Office Action issued in corresponding U.S. Appl. No. 15/487,694 dated Jun. 26, 2017.
Non-Final Office Action issued in U.S. Appl. No. 14/881,535 mailed Jul. 21, 2021.
Non-Final Office Action issued in U.S. Appl. No. 16/404,283 mailed Jul. 21, 2021.
Non-Final Office Action issued in U.S. Appl. No. 16/871,928 mailed Aug. 25, 2021.
Non-Final Office Action issued in U.S. Appl. No. 16/901,774 mailed Sep. 14, 2021.
Non-Final Office Action issued in U.S. Appl. No. 16/943,727 mailed Aug. 3, 2021.
Non-Final Office Action issued in U.S. Appl. No. 17/060,647 mailed Sep. 20, 2021.
Non-Final Office Action issued in U.S. Appl. No. 14/881,535 mailed May 20, 2020.
Non-Final Office Action issued in U.S. Appl. No. 15/145,443 mailed May 8, 2020.
Non-Final Office Action issued in U.S. Appl. No. 16/458,696 mailed May 22, 2020.
Non-Final Office Action issued in U.S. Appl. No. 16/564,186 mailed Oct. 15, 2021.
Non-Final Office Action issued in U.S. Appl. No. 16/871,328 mailed Dec. 9, 2021.
Non-Final Office Action issued in U.S. Appl. No. 16/943,935 mailed Oct. 21, 2021.
Non-Final Office Action issued Nov. 13, 2017 in related U.S. Appl. No. 15/644,487.
Non-Final Office Action issued Nov. 29, 2017 in related U.S. Appl. No. 15/145,414.
Non-Final Office Action issued Oct. 6, 2017 in related U.S. Appl. No. 14/881,535.
Non-Final Office Action Mailed Aug. 31, 2020 in U.S. Appl. No. 16/167,083.
Non-Final Office Action mailed Dec. 23, 2019 in related U.S. Appl. No. 16/597,008.
Non-Final Office Action mailed Dec. 6, 2019 in related U.S. Appl. No. 16/564,186.
Non-Final Office Action mailed Feb. 12, 2019 in related U.S. Appl. No. 16/170,695.
Non-Final Office Action mailed Feb. 25, 2019 in related U.S. Appl. No. 16/210,749.
Non-Final Office Action mailed Jan. 10, 2020 in related U.S. Appl. No. 16/597,014.
Non-Final Office Action mailed Jan. 29, 2021 in U.S. Appl. No. 16/564,185.
Non-Final Office Action mailed Jan. 4, 2021 in U.S. Appl. No. 16/522,043.
Non-Final Office Action mailed Mar. 6, 2019 in related U.S. Appl. No. 15/183,387.
Non-Final Office Action Mailed Sep. 2, 2020 in U.S. Appl. No. 16/356,263.
Non-Final Office Action Mailed Sep. 29, 2020 in U.S. Appl. No. 16/943,727.
Non-Final Office Mailed Oct. 26, 2020 in U.S. Appl. No. 15/356,436.
Non-Final Office Mailed Oct. 5, 2020 in U.S. Appl. No. 16/443,273.
"Griswold Model 811 Pumps: Installation, Operation and Maintenance Manual, ANSI Process Pump," 2010, 60 pages.
"Heat Exchanger" (https://en.wikipedia.org/w/index.php?title=Heat_exchanger&oldid=89300146) Dec. 18, 2019 Apr. 2019 (Apr. 18, 2019), entire document, especially para (0001).
"Process Burner" (https://www.cebasrt.com/productsloii-gaslprocess-bumer) Sep. 6, 2006, 2018 (Sep. 6, 2018), entire document, especially para (Burners for refinery Heaters).
"Water and Glycol Heating Systems" (https://www.heat-inc.com/wg-series-water-glycol-systems/) Jun. 18, 2018 Jun. 18, 2018), entire document, especially WG Series Water Glycol Systems.
Albone, "Mobile Compressor Stations for Natural Gas Transmission Service," ASME 67-GT-33, Turbo Expo, Power for Land, Sea and Air, vol. 79887, p. 1-10, 1967.
Canadian Patent Application No. 2,944,980, filed Aug. 12, 2016, 25 pages.
Canadian Office Action dated Apr. 18, 2018 in related Canadian Patent Application No. 2,928,711.
Canadian Office Action dated Mar. 2, 2018 in related Canadian Patent Application No. 2,833,711.

(56) References Cited

OTHER PUBLICATIONS

Canadian Office Action dated Sep. 28, 2018 in related Canadian Patent Application No. 2,945,281.
Canadian Office Action issued Aug. 31, 2020 in Canadian Patent Application No. 2,944,980.
Canadian Office Action issued in Canadian Application No. 3,094,768 mailed Oct. 28, 2021.
Canadian Office Action issued Sep. 22, 2020 in Canadian Application No. 2,982,974.
Canadian Office Action issued Sep. 8, 2020 in Canadian Patent Application No. 2,928,707.
Canadian Office Action mailed Aug. 17, 2020 in related CA Patent Application No. 2,944,968.
Canadian Office Action mailed Aug. 18, 2020 in related CA Patent Application No. 2,933,444.
Canadian Office Action mailed Jun. 20, 2019 in corresponding CA Application No. 2,964,597.
Canadian Office Action mailed Jun. 22, 2018 in related Canadian Patent Application No. 2,886,697.
Canadian Office Action mailed May 30, 2019 in corresponding CA Application No. 2,833,711.
Canadian Office Action mailed Oct. 1, 2019 in related Canadian Patent Application No. 2,936,997.
Final Office Action issued in corresponding U.S. Appl. No. 14/622,532 dated Dec. 21, 2015.
Final Office Action issued in corresponding U.S. Appl. No. 14/622,532 dated Dec. 7, 2016.
Final Office Action issued in corresponding U.S. Appl. No. 15/145,491 dated Jan. 20, 2017.
Final Office Action issued in corresponding U.S. Appl. No. 15/145,491 dated Sep. 6, 2017.
Final Office Action issued in corresponding U.S. Appl. No. 15/294,349 dated Jul. 6, 2017.
Final Office Action issued in U.S. Appl. No. 16/356,263 mailed Oct. 7, 2021.
Final Office Action mailed Feb. 4, 2021 in U.S. Appl. No. 16/597,014.
Final Office Action mailed Jan. 11, 2021 in U.S. Appl. No. 16/404,283.
Final Office Action mailed Jan. 21, 2021 in U.S. Appl. No. 16/458,696.
Final Office Action mailed Mar. 31, 2020 in U.S. Appl. No. 15/356,436.
Goodwin, "High-voltage auxilliary switchgear for power stations," Power Engineering Journal, 1989, 10 pg. (Year 1989).
International Search Report and Writen Opinion mailed Dec. 14, 2020 in PCT/US2020/53980.
International Search Report and Writen Opinion mailed Feb. 2, 2021 in PCT/US20/58906.
International Search Report and Writen Opinion mailed Feb. 3, 2021 in PCT/US20/58899.
International Search Report and Writen Opinion mailed Feb. 4, 2021 in PCT/US20/59834.
International Search Report and Writen Opinion mailed Jun. 2, 2020 in related PCT Application No. PCT/US20/23809.
International Search Report and Written Opinion dated Sep. 19, 2018 in related PCT Patent Application No. PCT/US2018/040683.
International Search Report and Written Opinion mailed Apr. 10, 2019 in corresponding PCT Application No. PCT/US2019/016635.
International Search Report and Written Opinion Mailed Aug. 28, 2020 in PCT/US20/23821.
International Search Report and Written Opinion mailed Dec. 31, 2018 in related PCT Patent Application No. PCT/US18/55913.
International Search Report and Written Opinion mailed Feb. 11, 2020 in related PCT Application No. PCT/US2019/055323.
International Search Report and Written Opinion mailed Feb. 15, 2019 in related PCT Application No. PCT/US18/63977.
International Search Report and Written Opinion mailed Jan. 2, 2019 in related PCT Patent Application No. PCT/US18/54542.
International Search Report and Written Opinion mailed Jan. 2, 2019 in related PCT Patent Application No. PCT/US18/54548.
International Search Report and Written Opinion mailed Jan. 2, 2020 in related PCT Application No. PCT/US19/55325.
International Search Report and Written Opinion mailed Jan. 4, 2019 in related PCT Patent Application No. PCT/US18/57539.
International Search Report and Written Opinion mailed Jul. 22, 2020 in corresponding PCT Application No. PCT/US20/00017.
International Search Report and Written Opinion mailed Jul. 9, 2019 in corresponding PCT Application No. PCT/US2019/027584.
International Search Report and Written Opinion mailed Jun. 23, 2020 in corresponding PCT Application No. PCT/US20/23912.
International Search Report and Written Opinion mailed Mar. 5, 2019 in related PCT Application No. PCT/US18/63970.
International Search Report and Written Opinion mailed Nov. 24, 2020 in corresponding PCT Application No. PCT/US20/44274.

* cited by examiner

TORSIONAL COUPLING FOR ELECTRIC HYDRAULIC FRACTURING FLUID PUMPS

CROSS-REFERENCE TO RELATED APPLICATIONS

This application is a continuation of U.S. patent application Ser. No. 17/379,651 filed Jul. 19, 2021 titled "TORSIONAL COUPLING FOR ELECTRIC HYDRAULIC FRACTURING FLUID PUMPS," which is now U.S. Pat. No. 11,549,346 issued Jan. 10, 2023, which is a continuation of U.S. patent application Ser. No. 15/581,625 filed Apr. 28, 2017 titled "TORSIONAL COUPLING FOR ELECTRIC HYDRAULIC FRACTURING FLUID PUMPS," which is now U.S. Pat. No. 11,066,912 issued Jul. 20, 2021, which is a continuation of U.S. patent application Ser. No. 14/622,532 filed Feb. 13, 2015 titled "TORSIONAL COUPLING FOR ELECTRIC HYDRAULIC FRACTURING FLUID PUMPS," which is now U.S. Pat. No. 9,650,879 issued May 16, 2017, which is a continuation-in-part of, and claims priority to and the benefit of, U.S. patent application Ser. No. 13/679,689 filed Nov. 16, 2012 titled "SYSTEM FOR PUMPING HYDRAULIC FRACTURING FLUID USING ELECTRIC PUMPS," which is now U.S. Pat. No. 9,410,410 issued Aug. 9, 2016, the full disclosures of which are incorporated herein by reference for all intents and purposes.

BACKGROUND OF THE INVENTION

1. Field of the Invention

This technology relates to hydraulic fracturing in oil and gas wells. In particular, this technology relates to pumping fracturing fluid into an oil or gas well using pumps powered by electric motors.

2. Brief Description of Related Art

Typically, motors are used at a well site to drive equipment. For example, diesel, gas, or electric motors might be used to drive pumps, blenders, or hydration units for carrying out hydraulic fracturing operations. Such motors are attached to the well site equipment by connecting the shaft of the motor to a shaft on the equipment, such a pump shaft for a pump, or a hydraulic motor shaft for a blender or a hydration unit. In order to compensate for misalignment between the motor and the equipment driven by the motor, a U-joint shaft is typically used. The U-joint shaft allows limited radial, angular, or even axial misalignment between the motor and the equipment, while still allowing mechanical communication between the shafts of the motor and the equipment to drive the equipment.

Use of U-joint shafts, however, can be problematic in practice. For example, U-joint shafts introduce inefficiencies into the system, losing up to 10% or more of the energy that would otherwise be transmitted from the motor shaft to the equipment. Furthermore, a minimum of 3 degrees of offset can be required between the motor and the equipment in order for the U-joint shaft to function properly. This offset leads to the need for a longer shaft, which in turn leads to greater separation between the motor and the equipment. Such separation can be problematic in setup where space is limited, for example, where both the motor and a pump are mounted to a trailer or truck body.

SUMMARY OF THE INVENTION

The present technology provides a system for hydraulically fracturing an underground formation in an oil or gas well. The system includes a pump for pumping hydraulic fracturing fluid into the wellbore at high pressure so that the fluid passes from the wellbore into the formation and fractures the formation, the pump having a pump shaft that turns to activate the pump. The system further includes an electric motor with a motor shaft mechanically attached to the pump to drive the pump, and a torsional coupling connecting the motor shaft to the pump shaft. The torsional coupling has a motor component fixedly attached to the motor shaft of the electric motor and having motor coupling claws extending outwardly away from the motor shaft, and a pump component fixedly attached to the pump shaft of the pump and having pump coupling claws extending outwardly away from the pump shaft. The motor coupling claws engage with the pump coupling claws so that when the motor shaft and motor component rotate, such rotation causes the pump component and the pump shaft to rotate, thereby driving the pump.

In some embodiments, the pump component or the motor component can further include elastomeric inserts positioned between the pump coupling claws or the motor coupling claws, respectively, to provide a buffer therebetween and to absorb movement and vibration in the torsional coupling. In addition, the motor coupling claws and the pump coupling claws can be spaced to allow radial misalignment, axial misalignment, or angular misalignment of the motor component and the pump component while still allowing engagement of the motor component and the pump component to transmit torque. Furthermore, the torsional coupling can further comprise a retainer cap attached to the motor component or the pump component to cover the interface therebetween and to prevent the ingress of debris or contaminates between the motor component and the pump component. The retainer cap can be removable from the torsional coupling to allow access to the inside of the coupling.

In some embodiments, the motor component can have a tapered central bore for receiving the motor shaft. In addition, the pump and the motor can be mounted on separate but aligned weldments. Alternatively, the pump and the motor can be mounted on a single common weldment Pump and motor mounted on single weldment for ease of alignment and stability.

Another embodiment of the present technology provides a system for pumping hydraulic fracturing fluid into a wellbore. The system includes a pump having a pump shaft, an electric motor having a motor shaft mechanically attached to the pump to drive the pump, and a torsional coupling connecting the motor shaft to the pump shaft. The torsional coupling includes a motor component fixedly attached to the motor shaft and having motor coupling claws extending outwardly away from the motor shaft, and a pump component fixedly attached to the pump shaft and having pump coupling claws extending outwardly away from the pump shaft. The motor coupling claws engage with the pump coupling claws so that when the motor shaft and motor component rotate, such rotation causes the pump component and the pump shaft to rotate. In addition, the motor coupling claws and the pump coupling claws are spaced to allow radial misalignment, axial misalignment, or angular misalignment of the motor component and the pump component, while still allowing engagement of the motor component and the pump component to transmit torque.

In some embodiments, the pump component or the motor component further include elastomeric inserts positioned between the pump coupling claws or the motor coupling claws, respectively, to provide a buffer therebetween and to absorb movement and vibration in the torsional coupling. In addition, the torsional coupling can further include a retainer cap attached to the motor component or the pump component to cover the interface therebetween and to prevent the ingress of debris or contaminates between the motor component and the pump component. The retainer cap can be removable from the torsional coupling to allow access to the inside of the coupling.

In some embodiments, the motor component can have a tapered central bore for receiving the motor shaft. In addition, the pump and the motor can be mounted on separate but aligned weldments. Alternatively, the pump and the motor can be mounted on a single common weldment Yet another embodiment of the present technology provides a system for conducting hydraulic fracturing operations in a well. The system includes hydraulic fracturing equipment, the hydraulic fracturing equipment selected from the group consisting of a hydraulic fracturing pump, a hydraulic motor of a blender, and a hydraulic motor of a hydration unit, the hydraulic fracturing equipment having a hydraulic fracturing equipment shaft. The system further includes an electric motor with a motor shaft mechanically attached to the hydraulic fracturing equipment to drive the hydraulic fracturing equipment, and a torsional coupling connecting the motor shaft to the hydraulic fracturing equipment shaft. The torsional coupling includes a motor component fixedly attached to the motor shaft of the electric motor and having motor coupling claws extending outwardly away from the motor shaft, and a hydraulic fracturing equipment component fixedly attached to the hydraulic fracturing equipment shaft of the hydraulic fracturing equipment and having hydraulic fracturing equipment coupling claws extending outwardly away from the hydraulic fracturing equipment shaft. The motor coupling claws engage with the hydraulic fracturing equipment coupling claws so that when the motor shaft and motor component rotate, such rotation causes the hydraulic fracturing equipment component and the hydraulic fracturing equipment shaft to rotate, thereby driving the hydraulic fracturing equipment.

In some embodiments, the hydraulic fracturing equipment component or the motor component can further include elastomeric inserts positioned between the hydraulic fracturing equipment coupling claws or the motor coupling claws, respectively, to provide a buffer therebetween and to absorb movement and vibration in the torsional coupling. In addition, the motor coupling claws and the hydraulic fracturing equipment coupling claws can be spaced to allow radial misalignment, axial misalignment, or angular misalignment of the motor component and the hydraulic fracturing equipment component while still allowing engagement of the motor component and the hydraulic fracturing equipment component to transmit torque.

In some embodiments, the torsional coupling can further include a retainer cap attached to the motor component or the hydraulic fracturing equipment component to cover the interface therebetween and to prevent the ingress of debris or contaminates between the motor component and the hydraulic fracturing equipment component. In addition, the motor component can have a tapered central bore for receiving the motor shaft.

BRIEF DESCRIPTION OF THE DRAWINGS

The present technology will be better understood on reading the following detailed description of nonlimiting embodiments thereof, and on examining the accompanying drawing, in which.

DETAILED DESCRIPTION OF THE PREFERRED EMBODIMENT

Figure 1:
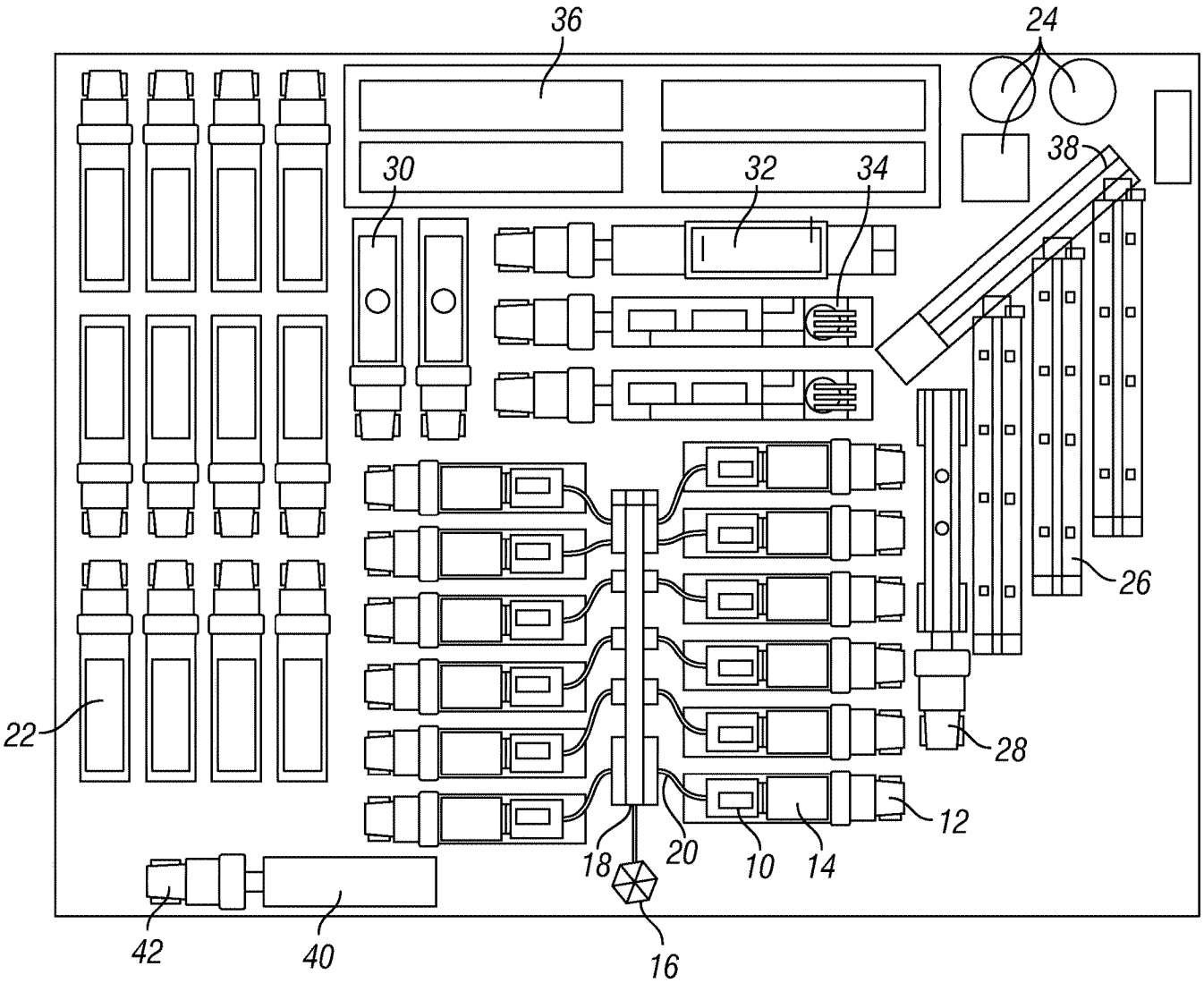
FIG. 1 is a schematic plan view of equipment used in a hydraulic fracturing operation, according to an embodiment of the present technology.

The foregoing aspects, features, and advantages of the present technology will be further appreciated when considered with reference to the following description of preferred embodiments and accompanying drawing, wherein like reference numerals represent like elements. In describing the preferred embodiments of the technology illustrated in the appended drawing, specific terminology will be used for the sake of clarity. However, the technology is not intended to be limited to the specific terms used, and it is to be understood that each specific term includes equivalents that operate in a similar manner to accomplish a similar purpose.

Figure 3:
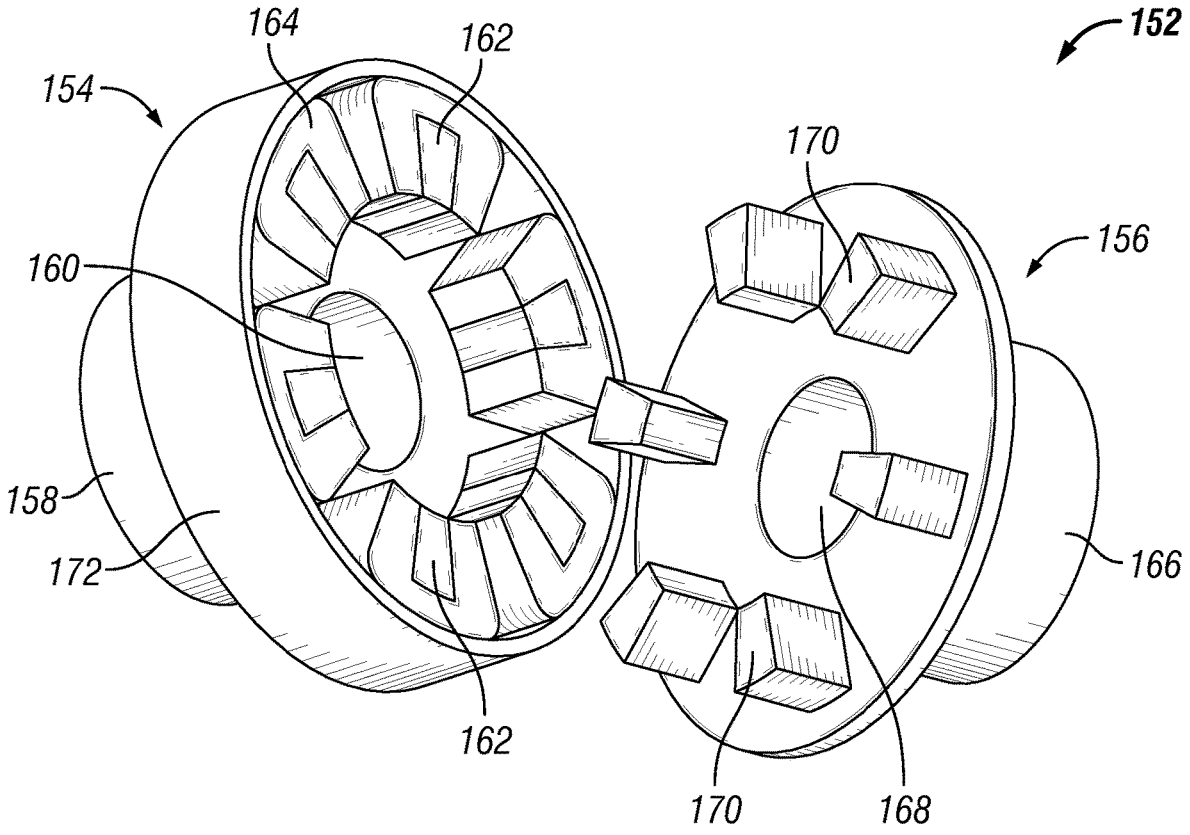
FIG. 3 is a perspective view of the torsional coupling with the components separated.
Figure 4:
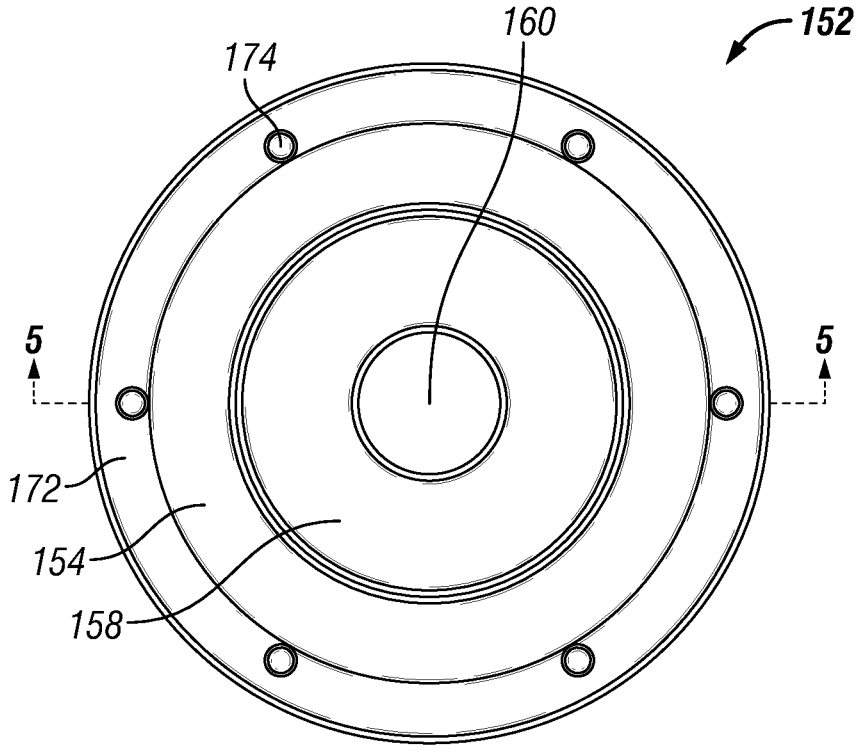
FIG. 4 is an end view of the torsional coupling according to an embodiment of the present technology.

FIG. 1 shows a plan view of equipment used in a hydraulic fracturing operation. Specifically, there is shown a plurality of pumps 10 mounted to vehicles 12, such as trailers (as shown, for example, in FIGS. 3 and 4). In the embodiment shown, the pumps 10 are powered by electric motors 14, which can also be mounted to the vehicles 12. The pumps 10 are fluidly connected to the wellhead 16 via the missile 18. As shown, the vehicles 12 can be positioned near enough to the missile 18 to connect fracturing fluid lines 20 between the pumps 10 and the missile 18. The missile 18 is then connected to the wellhead 16 and configured to deliver fracturing fluid provided by the pumps 10 to the wellhead 16. Although the vehicles 12 are shown in FIGS. 3 and 4 to be trailers, the vehicles could alternately be trucks, wherein the pumps motors 14, and other equipment are mounted directly to the truck.

In some embodiments, each electric motor 14 can be an induction motor, and can be capable of delivering about 1500 horsepower (HP), 1750 HP, or more. Use of induction motors, and in particular three-phase induction motors, allows for increased power output compared to other types of electric motors, such as permanent magnet (PM) motors. This is because three-phase induction motors have nine poles (3 poles per phase) to boost the power factor of the motors. Conversely, PM motors are synchronous machines that are accordingly limited in speed and torque. This means that for a PM motor to match the power output of a three-phase induction motor, the PM motor must rotate very fast, which can lead to overheating and other problems.

Each pump 10 can optionally be rated for about 2250 horsepower (HP) or more. In addition, the components of the system, including the pumps 10 and the electric motors 14, can be capable of operating during prolonged pumping operations, and in temperature in a range of about 0 degrees C. or less to about 55 degrees C. or more. In addition, each electric motor 14 can be equipped with a variable frequency drive (VFD) 15, and an A/C console, that controls the speed of the electric motor 14, and hence the speed of the pump 10.

The VFDs 15 of the present technology can be discrete to each vehicle 12 and/or pump Such a feature is advantageous because it allows for independent control of the pumps 10 and motors 14. Thus, if one pump 10 and/or motor 14 becomes incapacitated, the remaining pumps 10 and motors 14 on the vehicle 12 or in the fleet can continue to function, thereby adding redundancy and flexibility to the system. In addition, separate control of each pump 10 and/or motor 14 makes the system more scalable, because individual pumps 10 and/or motors 14 can be added to or removed from a site without modification to the VFDs 15.

The electric motors 14 of the present technology can be designed to withstand an oilfield environment. Specifically, some pumps 10 can have a maximum continuous power output of about 1500 HP, 1750 HP, or more, and a maximum continuous torque of about 8750 ft-lb, 11,485 ft-lb, or more. Furthermore, electric motors 14 of the present technology can include class H insulation and high temperature ratings, such as about 1100 degrees C. or more. In some embodiments, the electric motor 14 can include a single shaft extension and hub for high tension radial loads, and a high strength 4340 alloy steel drive shaft, although other suitable materials can also be used.

The VFD 15 can be designed to maximize the flexibility, robustness, serviceability, and reliability required by oilfield applications, such as hydraulic fracturing. For example, as far as hardware is concerned, the VFD 15 can include packaging receiving a high rating by the National Electrical Manufacturers Association (such as nema 1 packaging), and power semiconductor heat sinks having one or more thermal sensors monitored by a microprocessor to prevent semiconductor damage caused by excessive heat. Furthermore, with respect to control capabilities, the VFD 15 can provide complete monitoring and protection of drive internal operations while communicating with an operator via one or more user interfaces. For example, motor diagnostics can be performed frequently (e.g., on the application of power, or with each start), to prevent damage to a grounded or shorted electric motor 14. The electric motor diagnostics can be disabled, if desired, when using, for example, a low impedance or high-speed electric motor.

In some embodiments, the pump 10 can optionally be a 2250 HP triplex or quintuplex pump. The pump 10 can optionally be equipped with 4.5 inch diameter plungers that have an eight (8) inch stroke, although other size plungers can be used, depending on the preference of the operator. The pump 10 can further include additional features to increase its capacity, durability, and robustness, including, for example, a 6.353 to 1 gear reduction, autofrettaged steel or steel alloy fluid end, wing guided slush type valves, and rubber spring loaded packing. Alternately, pumps having slightly different specifications could be used. For example, the pump 10 could be equipped with 4 inch diameter plungers, and/or plungers having a ten (10) inch stroke.

Figure 2A:
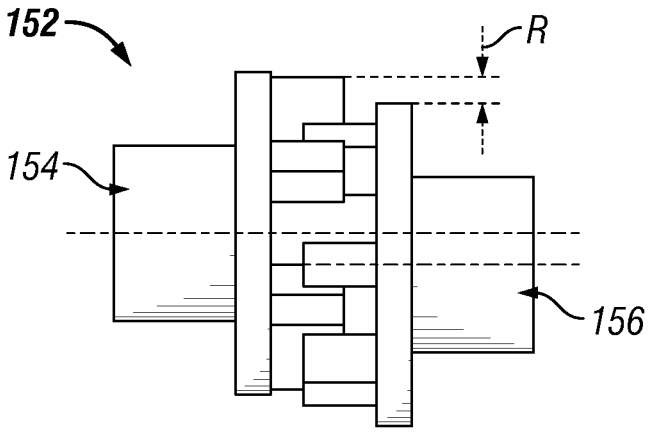
FIG. 2A is a side view of a torsional coupling according to the present technology with the components of the coupling radially misaligned.
Figure 2B:
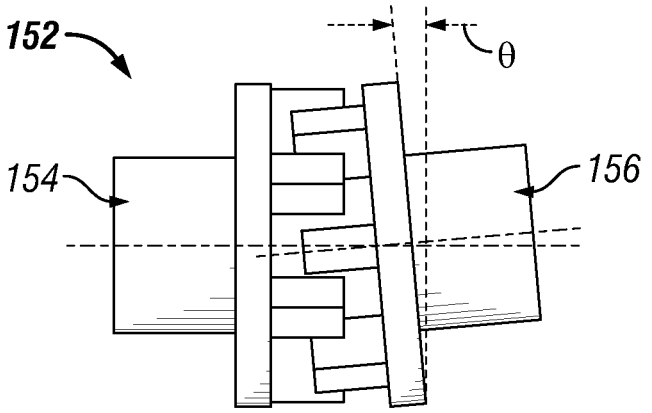
FIG. 2B is a side view of a torsional coupling according to the present technology with the components of the coupling angularly misaligned.
Figure 2C:
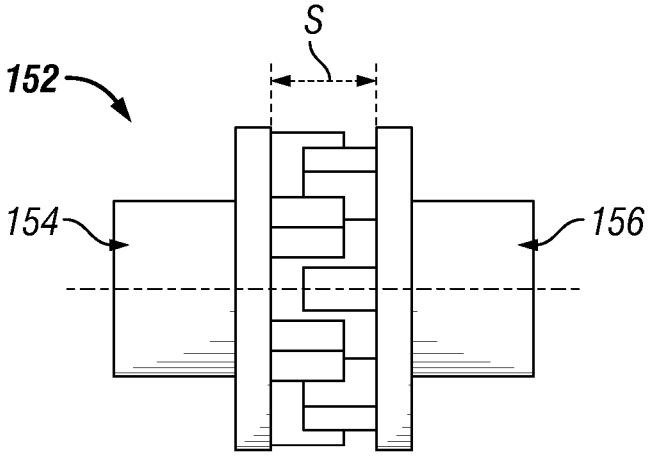
FIG. 2C is a side view of a torsional coupling according to the present technology with the components of the coupling axially misaligned.

In certain embodiments of the invention, the electric motor 14 can be connected to the pump 10 via a torsional coupling 152, of the type illustrated in FIGS. 2A-2C. Use of such a torsional coupling 152 is advantageous compared to use of, for example, a U-joint drive shaft to connect the motor 14 to the pump 10, because the torsional coupling 152 is more efficient. For example, in a typically system, in which a pump is connected to and powered by a diesel motor, the pump may be connected to the diesel motor using a U-joint drive shaft. Such drive shafts typically require at least a 3 degree offset, and they may lose up to 10% or more energy due to inefficiencies. By replacing the U-joint drive shaft with a torsional coupling 152 in the system of the present technology, this inefficiency can be reduced to 1% or less. In addition, the torsional coupling 152 allows for a shorter driveshaft than the U-joint drive shaft, thereby requiring a smaller space. Such space savings is valuable in particular for trailer or truck mounted systems.

The torsional coupling 152 of the present technology compensates for offset between a motor shaft and a pump shaft by allowing for some misalignment of the coupling components, while still maintaining an operative relationship between the components. For example, as shown in FIG. 2A, the pump component 154 of the coupling 152 can be radially offset from the motor component 156 of the coupling 152 by a radial distance R, and the two components 154, 156 may still be engaged so that when the motor component 156 rotates it causes rotation of the pump component 154. In fact, in some embodiments, the radial distance R can be up to 1.8 mm or more.

Similarly, as shown in FIG. 2B, the pump component 154 can be angled relative to the motor component 156 of the coupling 152 at an angle θ, and the two components 154, 156 may still be engaged. In some instances, the angle θ may be up to about 0.33 degrees. In addition, as shown in FIG. 2C, the pump component 154 can be axially separated from the motor component 156 by a distance S, and the two components 154, 156 may still be engaged. In some embodiments, the components 154, 156 can be axially separated by an axial distance S of up to 110 mm or more.

Referring now to FIG. 3, there is shown an isometric view of the pump component 154 and the motor component 156 of the coupling 152. The pump component 154 includes a protrusion 158 extending perpendicularly outward toward the pump (not shown), and which has a bore 160 configured to receive the shaft with an interference fit so that the pump component 154 transmits torque to the shaft of the pump when the pump component 154 turns. The pump component 154 also includes pump coupling claws 162 that extend inwardly toward the motor component 156 of the coupling 152 when the coupling 152 is made up. The pump coupling claws 162 are spaced circumferentially around the pump component 154. In some embodiments, such as that shown in FIG. 3, there can be six pump coupling claws 162, but any appropriate number can be used.

In addition to the above, the pump component 154 of the coupling 152 can include elastomeric inserts 164 surrounding at least a portion of the pump coupling claws 162 to provide a buffer between the pump coupling claws 162 of the pump component 154 and corresponding claws on the motor component 156. Such a buffer is advantageous to increase the ability of the coupling 152 to withstand shocks and vibrations associated with the use of heavy duty equipment such as hydraulic fracturing pumps. It is advantageous, when making up the coupling 152, to ensure that the components 154, 156 of the coupling are not mounted too far away from each other in and axial direction, so that the elastomeric inserts can transmit torque over the entire width of the inserts.

Also shown in FIG. 3 is an isometric view of the motor component 156 according to an embodiment of the present technology. The motor component 156 includes a protrusion 166 extending perpendicularly outward toward the motor (not shown), and which has a bore 168. The bore 168 engages the shaft of the motor with an interference fit, so that the motor component 156 receives torque from the shaft of the motor. In some embodiments, the shaft may be tapered, as described in greater detail below. This taper helps, among other things, to properly set the depth of the motor shaft relative to the motor component 156 when making up the coupling 152. The interference fit of the pump shaft and the motor shaft into the pump and motor components 154, 156 of the coupling 152 can be achieved by heating the pump and motor components 154, 156 to, for example, about 250 degrees Fahrenheit, and installing the components on their respective shafts while hot. Thereafter, as the pump and motor components 154, 156 cool, the inner diameters of the bores 160, 168 in the pump and motor components 154, 156 decrease, thereby creating an interference fit between the pump and motor components 154, 156 and the pump and motor shafts, respectively.

The motor component 156 also includes motor coupling claws 170 that extend inwardly toward the pump component 154 of the coupling 152 when the coupling 152 is made up. The motor coupling claws 170 are spaced circumferentially around the motor component 156 so as to correspond to voids between the pump coupling claws 162 and elastomeric inserts 164 when the coupling 152 is made up. In some embodiments, a retainer cap 172 can be included to cover the interface between the pump component 154 and the motor component 156, to protect, for example, the coupling 152 from the ingress of foreign objects or debris. The retainer cap 172 can be integral to the pump component 154 or it can be a separate piece that is fastened to the pump component 154.

Thus, when the coupling 152 is made up, the motor shaft, which is inserted into the bore 168 of the motor component 156, can turn and transmit torque to the motor component 156 of the coupling 152. As the motor component 156 of the coupling 152 turns, the motor coupling teeth 170 transmit torque to the pump coupling teeth 162 through the elastomeric inserts 164. Such torque transmission in turn causes the pump component 154 of the coupling 152 to turn, which transmits torque to the pump shaft engaged with the bore 160 of the pump component 154. The transmission of torque through the coupling 152 occurs even if the motor component 156 and the pump component 154 are radially offset, positioned at an angle to one another, or separated by an axial distance, as shown in FIGS. 2A-2C.

Referring now to FIG. 4, there is shown an end view of the coupling 152 looking from the pump side of the coupling 152 toward the motor. In particular, there is shown the pump component 154 of the coupling 152, including the protrusion 158 and the bore 160 for receiving the pump shaft. In the embodiment of FIG. 4, the retainer cap 172 is a separate piece from the pump component 154, and is attached to the pump component 154 with fasteners 174. In this embodiment shown, the fasteners 174 are shown to be bolts, but any appropriate fasteners could be used. Provision of a removable retainer cap 172 can be advantageous because it allows easier access to the interior components of the coupling 152 for servicing or repair. For example, if an operator desires to replace the elastomeric inserts 164 within the coupling 152, it need only remove the retainer cap 172, after which it can easily replace the elastomeric inserts 164.

Figure 5:
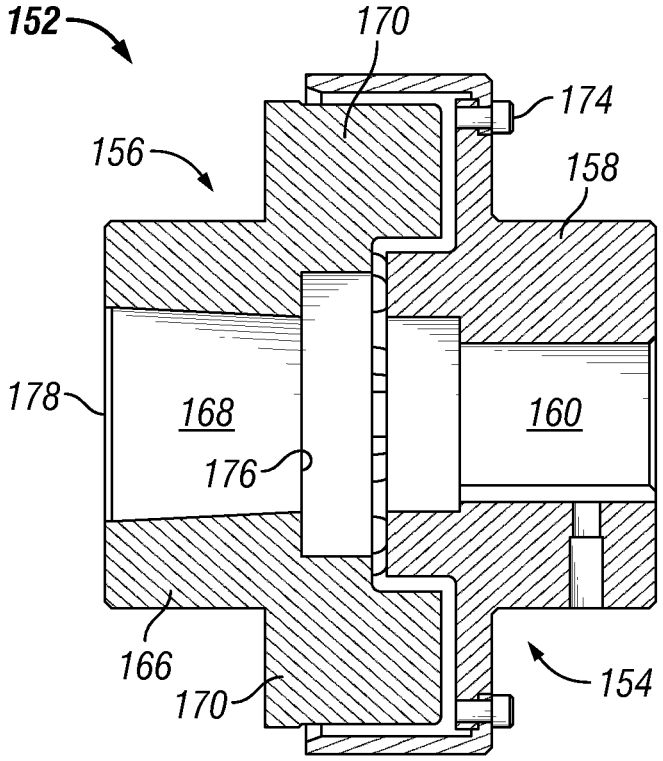
FIG. 5 is a side cross-sectional view of the torsional coupling of FIG. 4 taken along the line 5-5 in FIG. 4.

FIG. 5 shows a cross-sectional view of the coupling 152 of FIG. 3, taken along line 5-5. As shown in FIG. 5, the bore 168 in the protrusion 166 of the motor component 156 of the coupling 152 can be tapered from a smaller diameter at an inward side 176 of the motor component 156 (toward the pump component 154) to a larger diameter at an outward side 178 of the motor component (toward the motor). The tapered diameter of the bore 168 corresponds to a similarly tapered end of the motor shaft, and helps with torque transmission and depth setting of the motor shaft relative to the coupling 152 when the coupling 152 is made up.

Figure 6:
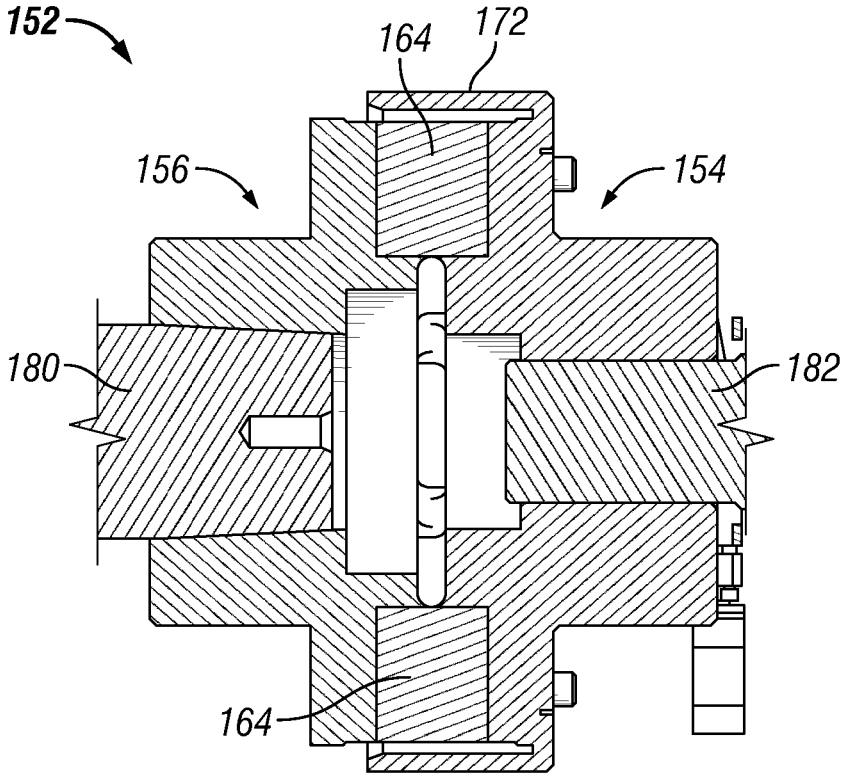
FIG. 6 is a side cross-sectional view of the torsional coupling according to an alternate embodiment of the present technology.

FIG. 6 shows a cross-sectional view of the coupling 152 according to an alternate embodiment of the present technology, and including the motor shaft 180 and pump shaft 182. In addition, in the view shown in FIG. 6, there is shown the elastomeric inserts 164 in the coupling. Furthermore, the embodiment shown in FIG. 6 differs from that shown in FIG. 5 in that the retainer cap 172 is integral to the pump component 154 (as opposed to being a separate piece, as depicted in FIGS. 4 and 5).

Figure 7A:
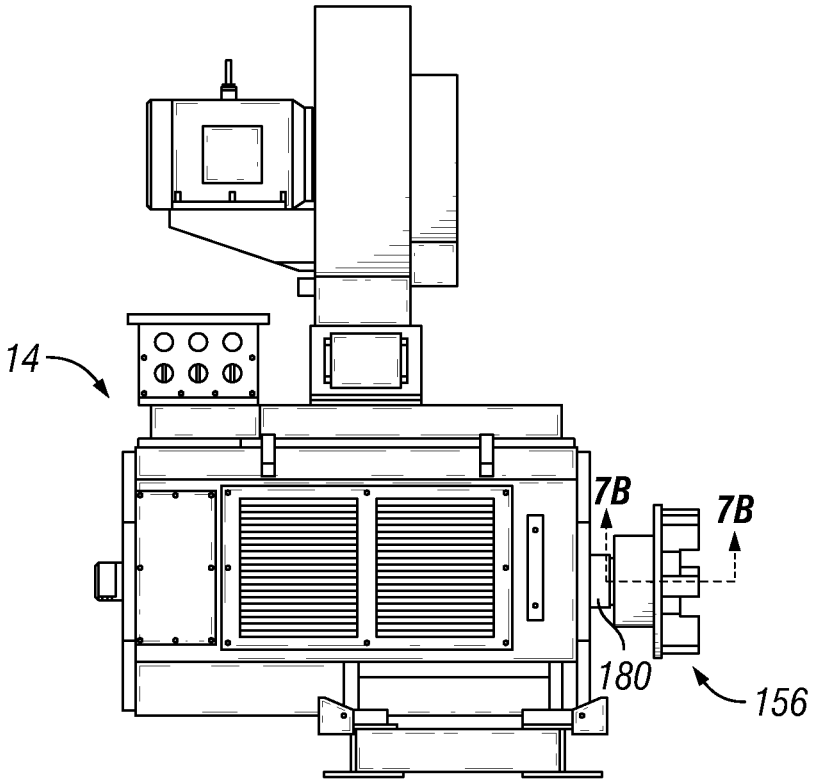
FIG. 7A is a side view of a motor according to an embodiment of the present technology with a part of the torsional coupling mounted to the motor shaft.
Figure 7B:
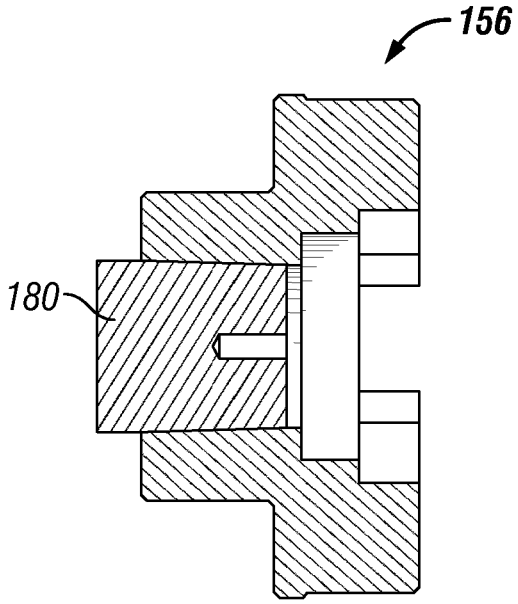
FIG. 7B is a side cross-sectional view of the part of the torsional coupling shown in FIG. 7A, taken along line 7B-7B.

FIG. 7A shows the motor component 156 of the coupling 152 attached to a motor 14. As can be seen, the motor shaft 180 extends outwardly from the motor 14 and into engagement with the motor component 156. FIG. 7B shows how the end of the motor shaft 180 is tapered so that it fits within the tapered bore 168 of the motor component 156. With the motor shaft 180 thus engaged with the motor component 156, the motor shaft 180 transmits torque to the motor component 156 as the shaft 180 turns, thereby turning the motor component 156 as well.

Figure 8:
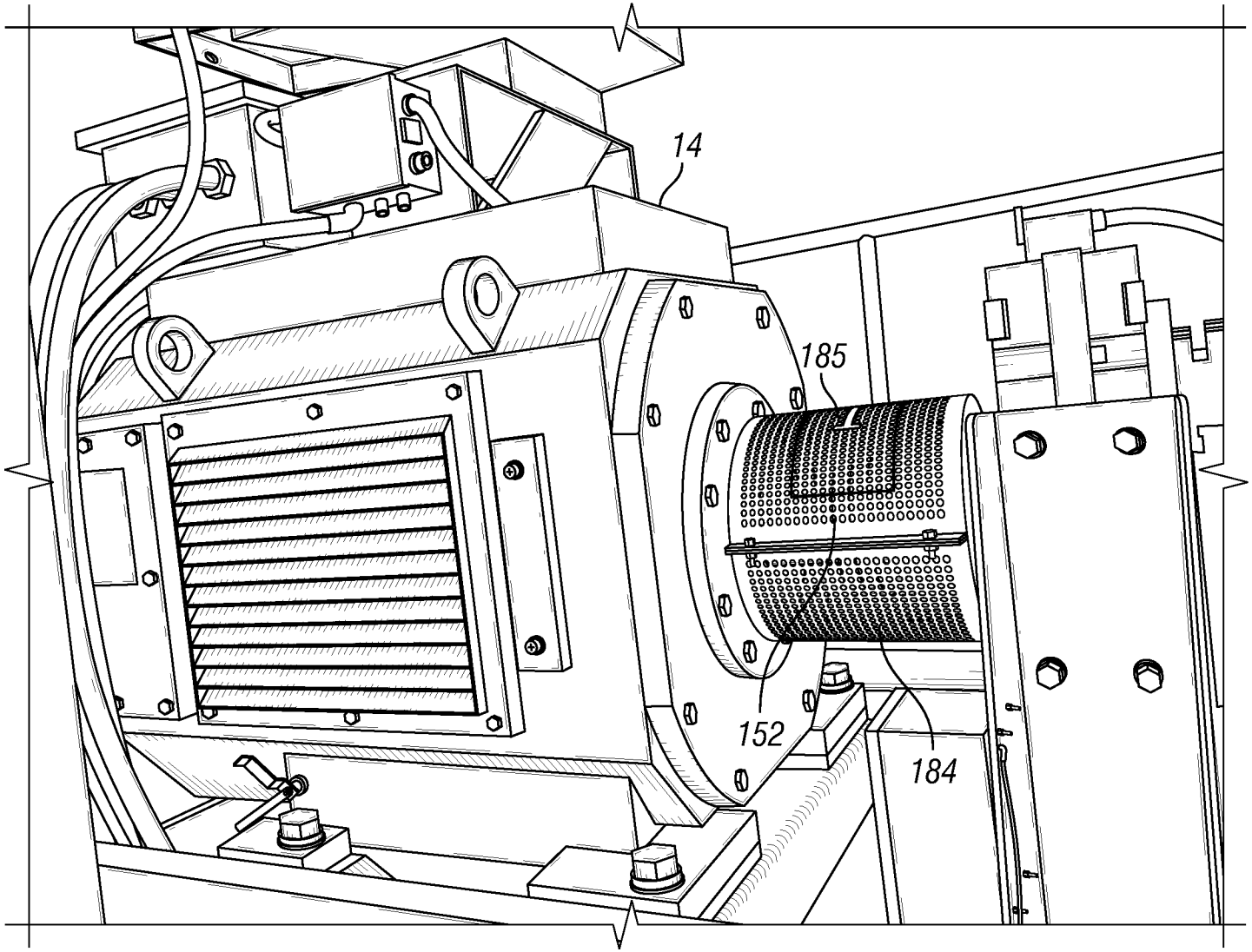
FIG. 8 is a perspective view of a motor and torsional coupling according to an embodiment of the present technology.

Referring now to FIG. 8, there is shown a motor 14 according to an embodiment of the present invention, and a coupling 152. There is also shown a protective cage 184 surrounding the coupling 152. The protective cage provides the advantage of protecting the coupling 152 from damage. In addition, the protective cage 184 can have a removable panel 185, or can otherwise be removable, to allow access to the coupling for repair and maintenance.

The coupling 152 of the present technology can be built out of any suitable materials, including composite materials, and is designed to allow for high torsional forces. For example, the torque capacity of the coupling could be up to about 450,000 lb-in. In addition, when the motor, pump, and associated coupling 152 are mounted to a trailer, truck, skid, or other equipment, various sized shim plates can be used to allow for more precise positioning of the equipment, thereby leading to appropriate alignment of the shafts and coupling components. Support brackets may also be provided to fix the motor and the pump in place relative to the trailer, truck, skid, or other equipment, thereby helping to maintain such alignment.

Figure 9:
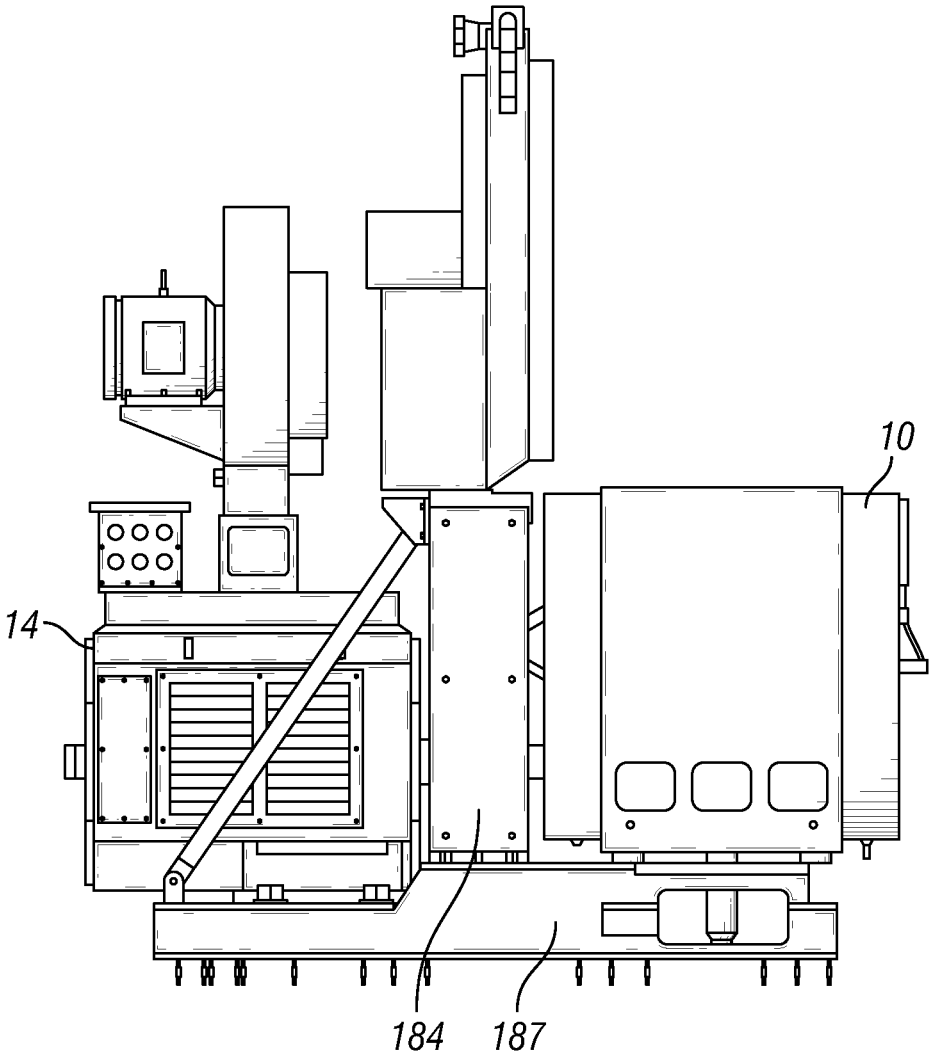
FIG. 9 is a side view of a motor and pump mounted to a single weldment.

Furthermore, the pump and motor mounting may be separate weldments, or, as shown in FIG. 9, they may alternatively be a combined single weldment 187. If they are a single weldment 187, the mounting faces can be machined, leveled, and planar to each other to increase the accuracy of alignment. Attaching the motor 14 and pump 10 to a single weldment 187 can be advantageous because it can improve alignment of the components, which can lead to reduced torsional stresses in the coupling. Mounting the motor 14 and pump 10 to a single weldment 187 also helps to ensure that during transport or operation, the motor 14 and pump are moved together, so that alignment of the coupling halves can be better maintained. In embodiments using separate weldments, the motor 14 can move independently of the pump 10, thereby causing a misalignment of the components, and possible damage to the coupling. In addition, the separate weldments can have a greater tendency to warp, requiring additional effort to get the alignment in the acceptable range.

Use of the coupling 152 complements the combination of a triplex, plunger pump, and an electric motor 14, because such a pump 10 and motor 14 are torsionally compatible. In other words, embodiments using this pump 10 and motor 14 are substantially free of serious torsional vibration, and vibration levels in the pump input shaft and in the coupling 152 are, as a result, kept within acceptable levels.

For example, experiments testing the vibration of the system of the present technology have indicated that, in certain embodiments, the motor shaft vibratory stress can be about 14% of the allowable limit in the industry. In addition, the coupling maximum combined order torque can be about 24% of the allowable industry limit, vibratory torque can be about 21% of the allowable industry limit, and power loss can be about 25% of the allowable industry limit. Furthermore, the gearbox maximum combined order torque can be about 89% of the standard industry recommendations, and vibratory torque can be about 47% of standard industry recommendations, while the fracturing pump input shaft combined order vibratory stress can be about 68% of the recommended limit.

The coupling 152 can further be used to connect the motor shaft 180 with other equipment besides a pump. For example, the coupling 152 can be used to connect the motor to a hydraulic drive powering multiple hydraulic motors in a hydration unit, or associated with blender equipment. In any of these applications, it is advantageous to provide a protective cage around the coupling 152, and also to provide an easy access panel in the protective cage to provide access to the coupling 152.

In addition to the above, certain embodiments of the present technology can optionally include a skid (not shown) for supporting some or all of the above-described equipment. For example, the skid can support the electric motor 14 and the pump 10. In addition, the skid can support the VFD 15. Structurally, the skid can be constructed of heavy-duty longitudinal beams and cross-members made of an appropriate material, such as, for example, steel. The skid can further include heavy-duty lifting lugs, or eyes, that can optionally be of sufficient strength to allow the skid to be lifted at a single lift point. It is to be understood, however, that a skid is not necessary for use and operation of the technology, and the mounting of the equipment directly to a vehicle 12 without a skid can be advantageous because it enables quick transport of the equipment from place to place, and increased mobility of the pumping system.

Referring back to FIG. 1, also included in the equipment is a plurality of electric generators 22 that are connected to, and provide power to, the electric motors 14 on the vehicles 12. To accomplish this, the electric generators 22 can be connected to the electric motors 14 by power lines (not shown). The electric generators 22 can be connected to the electric motors 14 via power distribution panels (not shown). In certain embodiments, the electric generators 22 can be powered by natural gas. For example, the generators can be powered by liquefied natural gas. The liquefied natural gas can be converted into a gaseous form in a vaporizer prior to use in the generators. The use of natural gas to power the electric generators 22 can be advantageous because above ground natural gas vessels 24 can already be placed on site in a field that produces gas in sufficient quantities. Thus, a portion of this natural gas can be used to power the electric generators 22, thereby reducing or eliminating the need to import fuel from offsite. If desired by an operator, the electric generators 22 can optionally be natural gas turbine generators, such as those shown in FIG. 10. The generators can run on any appropriate type of fuel, including liquefied natural gas (LNG).

FIG. 1 also shows equipment for transporting and combining the components of the hydraulic fracturing fluid used in the system of the present technology. In many wells, the fracturing fluid contains a mixture of water, sand or other proppant, acid, and other chemicals. Examples of fracturing fluid components include acid, anti-bacterial agents, clay stabilizers, corrosion inhibitors, friction reducers, gelling agents, iron control agents, pH adjusting agents, scale inhibitors, and surfactants. Historically, diesel has at times been used as a substitute for water in cold environments, or where a formation to be fractured is water sensitive, such as, for example, clay. The use of diesel, however, has been phased out over time because of price, and the development of newer, better technologies.

In FIG. 1, there are specifically shown sand transporting vehicles 26, an acid transporting vehicle 28, vehicles for transporting other chemicals 30, and a vehicle carrying a hydration unit 32. Also shown are fracturing fluid blenders 34, which can be configured to mix and blend the components of the hydraulic fracturing fluid, and to supply the hydraulic fracturing fluid to the pumps 10. In the case of liquid components, such as water, acids, and at least some chemicals, the components can be supplied to the blenders 34 via fluid lines (not shown) from the respective component vehicles, or from the hydration unit 32. In the case of solid components, such as sand, the component can be delivered to the blender 34 by a conveyor belt 38. The water can be supplied to the hydration unit 32 from, for example, water tanks 36 onsite. Alternately, the water can be provided by water trucks. Furthermore, water can be provided directly from the water tanks 36 or water trucks to the blender 34, without first passing through the hydration unit 32.

In certain embodiments of the technology, the hydration units 32 and blenders 34 can be powered by electric motors. For example, the blenders 34 can be powered by more than one motor, including motors having 600 horsepower or more, and motors having 1150 horsepower or more. The hydration units 32 can be powered by electric motors of 600 horsepower or more. In addition, in some embodiments, the hydration units 32 can each have up to five (5) chemical additive pumps, and a 200 bbl steel hydration tank.

Pump control and data monitoring equipment 40 can be mounted on a control vehicle 42, and connected to the pumps 10, electric motors 14, blenders 34, and other downhole sensors and tools (not shown) to provide information to an operator, and to allow the operator to control different parameters of the fracturing operation. For example, the pump control and data monitoring equipment 40 can include an A/C console that controls the VFD 15, and thus the speed of the electric motor 14 and the pump 10. Other pump control and data monitoring equipment can include pump throttles, a pump VFD fault indicator with a reset, a general fault indicator with a reset, a main estop, a programmable logic controller for local control, and a graphics panel. The graphics panel can include, for example, a touchscreen interface.

Figure 10:
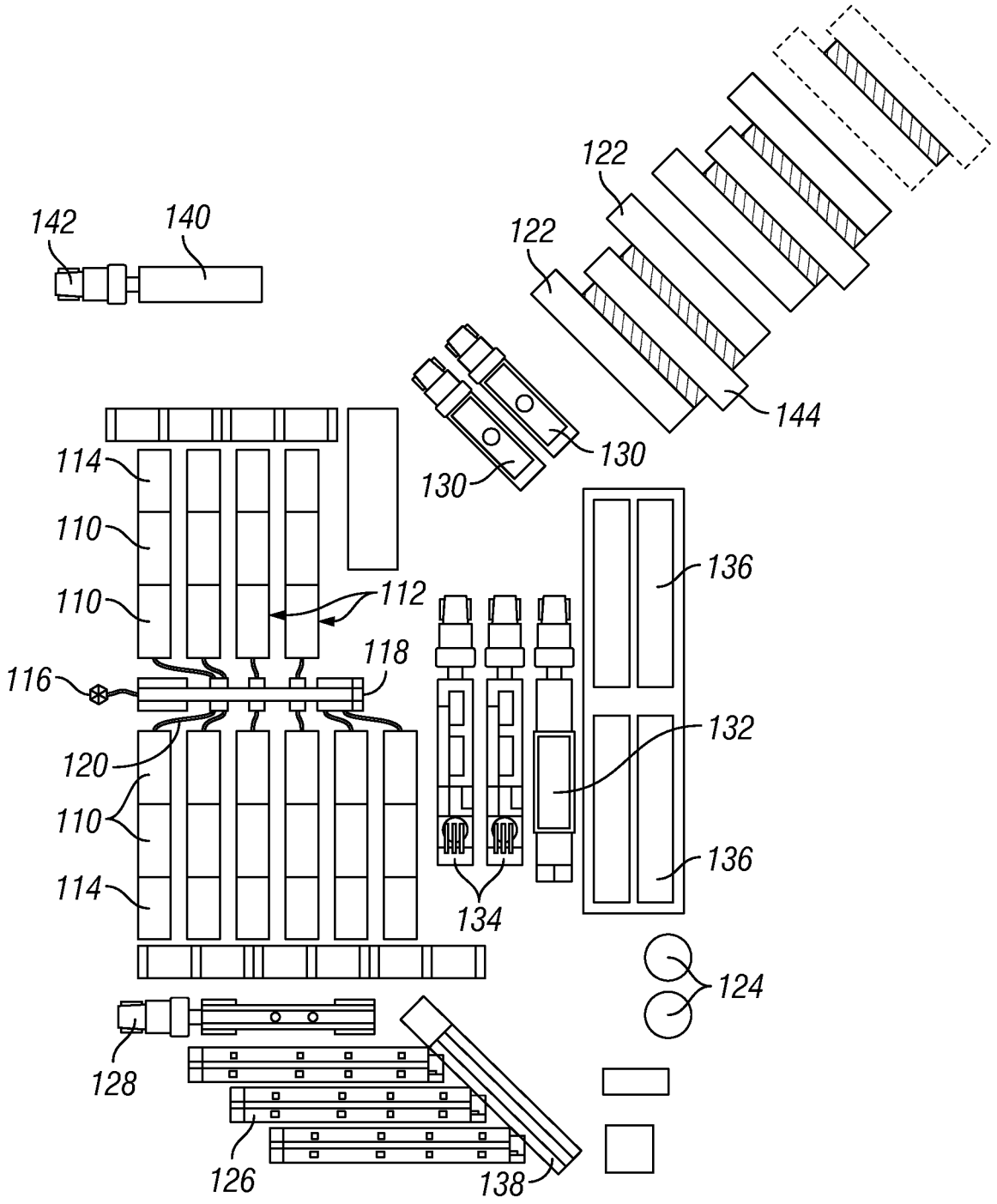
FIG. 10 is a schematic plan view of equipment used in a hydraulic fracturing operation, according to an alternate embodiment of the present technology.

Referring now to FIG. 10, there is shown an alternate embodiment of the present technology. Specifically, there is shown a plurality of pumps 110 which, in this embodiment, are mounted to pump trailers 112. As shown, the pumps 110 can optionally be loaded two to a trailer 112, thereby minimizing the number of trailers needed to place the requisite number of pumps at a site. The ability to load two pumps 110 on one trailer 112 is possible because of the relatively light weight of the electric powered pumps 110 compared to other known pumps, such as diesel pumps. In the embodiment shown, the pumps 110 are powered by electric motors 114, which can also be mounted to the pump trailers 112. Furthermore, each electric motor 114 can be equipped with a VFD 115, and an A/C console, that controls the speed of the motor 114, and hence the speed of the pumps 110.

The VFDs 115 shown in FIG. 10 can be discrete to each pump trailer 112 and/or pump 110. Such a feature is advantageous because it allows for independent control of the pumps 110 and motors 114. Thus, if one pump 110 and/or motor 114 becomes incapacitated, the remaining pumps 110 and motors 114 on the pump trailers 112 or in the fleet can continue to function, thereby adding redundancy and flexibility to the system. In addition, separate control of each pump 110 and/or motor 114 makes the system more scalable, because individual pumps 110 and/or motors 114 can be added to or removed from a site without modification to the VFDs 115.

In addition to the above, and still referring to FIG. 10, the system can optionally include a skid (not shown) for supporting some or all of the above-described equipment. For example, the skid can support the electric motors 114 and the pumps 110. In addition, the skid can support the VFD 115. Structurally, the skid can be constructed of heavy-duty longitudinal beams and cross-members made of an appropriate material, such as, for example, steel. The skid can further include heavy-duty lifting lugs, or eyes, that can optionally be of sufficient strength to allow the skid to be lifted at a single lift point. It is to be understood that a skid is not necessary for use and operation of the technology and the mounting of the equipment directly to a trailer 112 may be advantageous because if enables quick transport of the equipment from place to place, and increased mobility of the pumping system, as discussed above.

The pumps 110 are fluidly connected to a wellhead 116 via a missile 118. As shown, the pump trailers 112 can be positioned near enough to the missile 118 to connect fracturing fluid lines 120 between the pumps 110 and the missile 118. The missile 118 is then connected to the wellhead 116 and configured to deliver fracturing fluid provided by the pumps 110 to the wellhead 116.

This embodiment also includes a plurality of turbine generators 122 that are connected to, and provide power to, the electric motors 114 on the pump trailers 112. To accomplish this, the turbine generators 122 can be connected to the electric motors 114 by power lines (not shown). The turbine generators 122 can be connected to the electric motors 114 via power distribution panels (not shown). In certain embodiments, the turbine generators 122 can be powered by natural gas, similar to the electric generators 22 discussed above in reference to the embodiment of FIG. 1. Also included are control units 144 for the turbine generators 122. The control units 144 can be connected to the turbine generators 122 in such a way that each turbine generator 122 is separately controlled. This provides redundancy and flexibility to the system, so that if one turbine generator 122 is taken off line (e.g., for repair or maintenance), the other turbine generators 122 can continue to function.

The embodiment of FIG. 10 can include other equipment similar to that discussed above. For example, FIG. 10 shows sand transporting vehicles 126, acid transporting vehicles 128, other chemical transporting vehicles 130, hydration unit 132, blenders 134, water tanks 136, conveyor belts 138, and pump control and data monitoring equipment 140 mounted on a control vehicle 142. The function and specifications of each of these is similar to corresponding elements shown in FIG. 1.

Figure 11:
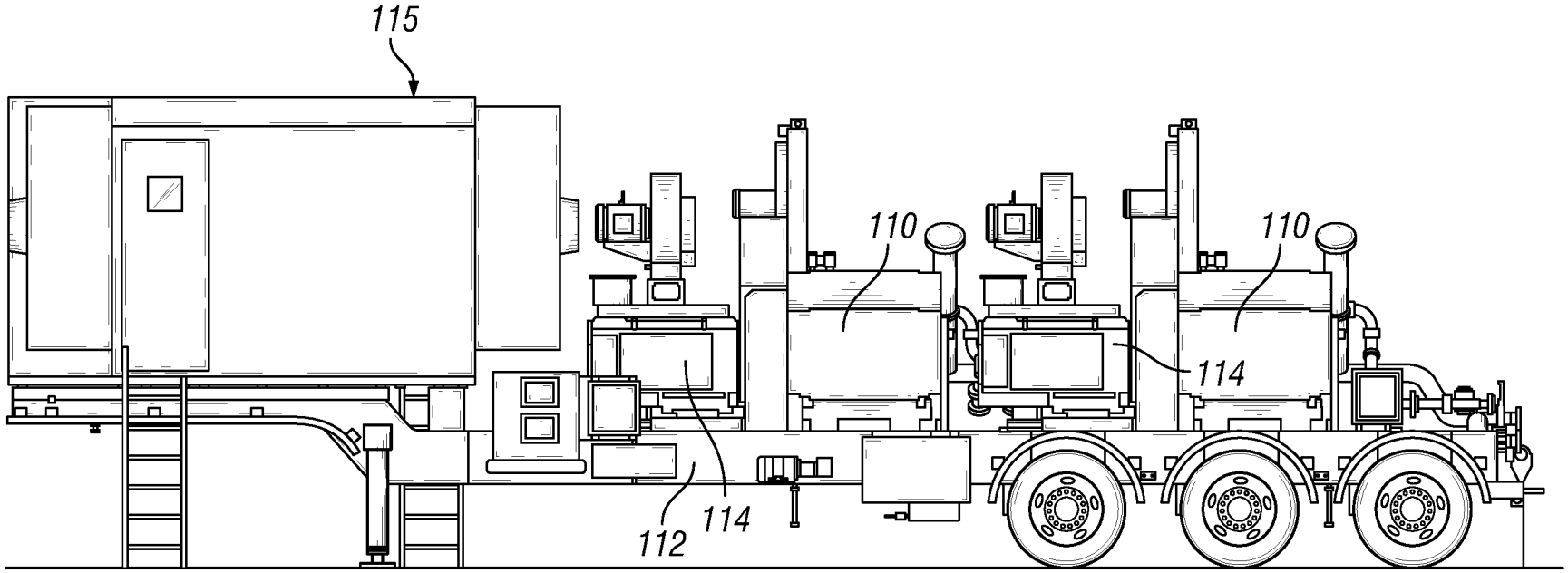
FIG. 11 is a left side view of equipment used to pump fracturing fluid into a well and mounted on a trailer, according to an embodiment of the present technology.
Figure 12:
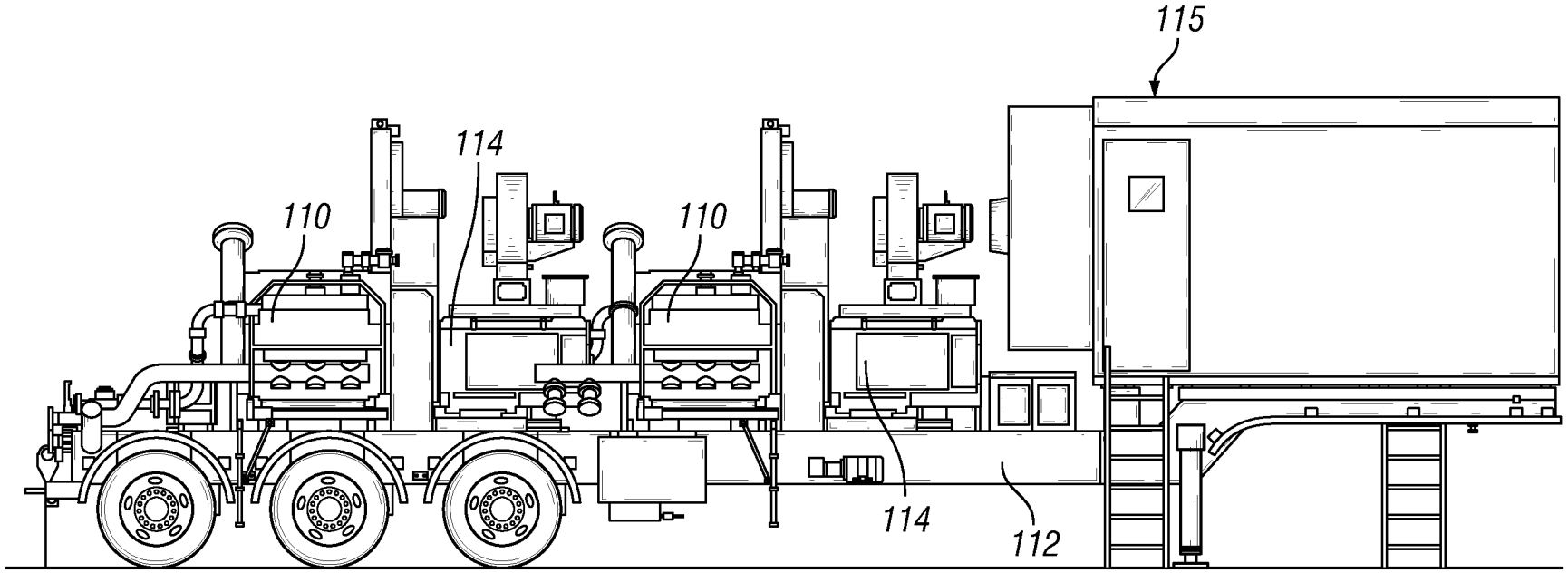
FIG. 12 is a right side view of the equipment and trailer shown in FIG. 3.

Use of pumps 10, 110 powered by electric motors 14, 114 and natural gas powered electric generators 22 (or turbine generators 122) to pump fracturing fluid into a well is advantageous over known systems for many different reasons. For example, the equipment (e.g. pumps, electric motors, and generators) is lighter than the diesel pumps commonly used in the industry. The lighter weight of the equipment allows loading of the equipment directly onto a truck body or trailer. Where the equipment is attached to a skid, as described above, the skid itself can be lifted on the truck body, along with all the equipment attached to the skid. Furthermore, and as shown in FIGS. 11 and 12, trailers 112 can be used to transport the pumps 110 and electric motors 114, with two or more pumps 110 carried on a single trailer 112. Thus, the same number of pumps 110 can be transported on fewer trailers 112. Known diesel pumps, in contrast, cannot be transported directly on a truck body or two on a trailer, but must be transported individually on trailers because of the great weight of the pumps.

The ability to transfer the equipment of the present technology directly on a truck body or two to a trailer increases efficiency and lowers cost. In addition, by eliminating or reducing the number of trailers to carry the equipment, the equipment can be delivered to sites having a restricted amount of space, and can be carried to and away from worksites with less damage to the surrounding environment. Another reason that the electric powered pump system of the present technology is advantageous is that it runs on natural gas. Thus, the fuel is lower cost, the components of the system require less maintenance, and emissions are lower, so that potentially negative impacts on the environment are reduced.

More detailed side views of the trailers 112, having various system components mounted thereon, are shown in FIGS. 11 and 12, which show left and right side views of a trailer 112, respectively. As can be seen, the trailer 112 can be configured to carry pumps 110, electric motors 114 and a VFD 115. Thus configured, the motors 114 and pumps 110 can be operated and controlled while mounted to the trailers 112. This provides advantages such as increased mobility of the system. For example, if the equipment needs to be moved to a different site, or to a repair facility, the trailer can simply be towed to the new site or facility without the need to first load the equipment onto a trailer or truck, which can be a difficult and hazardous endeavor. This is a clear benefit over other systems, wherein motors and pumps are attached to skids that are delivered to a site and placed on the ground.

In order to provide a system wherein the pumps 110, motors 114, and VFDs 115 remain trailer mounted, certain improvements can be made to the trailers 112. For example, a third axle 146 can be added to increase the load capacity of the trailer and add stability. Additional supports and cross members 148 can be added to support the motors' torque. In addition, the neck 149 of the trailer can be modified by adding an outer rib 150 to further strengthen the neck 149. The trailer can also include specially designed mounts 152 for the VFD 115 that allow the trailer to move independently of the VFD 115, as well as specially designed cable trays for running cables on the trailer 112. Although the VFD 115 is shown attached to the trailer in the embodiment of FIGS. 11 and 12, it could alternately be located elsewhere on the site, and not mounted to the trailer 112.

In practice, a hydraulic fracturing operation can be carried out according to the following process. First, the water, sand, and other components are blended to form a fracturing fluid, which is pumped down the well by the electric-powered pumps. Typically, the well is designed so that the fracturing fluid can exit the wellbore at a desired location and pass into the surrounding formation. For example, in some embodiments the wellbore can have perforations that allow the fluid to pass from the wellbore into the formation. In other embodiments, the wellbore can include an openable sleeve, or the well can be open hole. The fracturing fluid can be pumped into the wellbore at a high enough pressure that the fracturing fluid cracks the formation, and enters into the cracks. Once inside the cracks, the sand, or other proppants in the mixture, wedges in the cracks, and holds the cracks open.

Using the pump control and data monitoring equipment 40, 140 the operator can monitor, gauge, and manipulate parameters of the operation, such as pressures, and volumes of fluids and proppants entering and exiting the well. For example, the operator can increase or decrease the ratio of sand to water as the fracturing process progresses and circumstances change.

This process of injecting fracturing fluid into the wellbore can be carried out continuously, or repeated multiple times in stages, until the fracturing of the formation is optimized. Optionally, the wellbore can be temporarily plugged between each stage to maintain pressure, and increase fracturing in the formation. Generally, the proppant is inserted into the cracks formed in the formation by the fracturing, and left in place in the formation to prop open the cracks and allow oil or gas to flow into the wellbore.

While the technology has been shown or described in only some of its forms, it should be apparent to those skilled in the art that it is not so limited, but is susceptible to various changes without departing from the scope of the technology. Furthermore, it is to be understood that the above disclosed embodiments are merely illustrative of the principles and applications of the present technology. Accordingly, numerous modifications can be made to the illustrative embodiments and other arrangements can be devised without departing from the spirit and scope of the present technology as defined by the appended claims.

What is claimed is:

1. A system for hydraulically fracturing an underground formation in an oil or gas well, the system comprising:

a pump for pumping hydraulic fracturing fluid into a wellbore, the pump having a pump shaft that turns to activate the pump;

an electric motor with a motor shaft to drive the pump via the pump shaft;

a variable frequency drive and an alternating current console to control the speed of the electric motor to protect against overheating; and a torsional coupling connecting the electric motor to the pump shaft, the torsional coupling comprising:

a motor component coupled to the motor shaft of the electric motor; and a pump component coupled to the pump shaft of the pump;

the motor component engaged with the pump component to transmit power from the electric motor to the pump when the motor shaft and the motor component rotate, the motor component contacting the pump component so that the pump component and the pump shaft rotate, thereby driving the pump; and the system further comprising buffers between the motor component and the pump component.

2. The system of claim 1, wherein the motor component further comprises motor coupling claws and the pump component further comprises pump coupling claws, and wherein the motor coupling claws and the pump coupling claws are spaced to allow at least one of radial, axial, or angular misalignment of the motor component and the pump component while still allowing engagement of the motor component and the pump component to transmit torque.

3. The system of claim 1, wherein the torsional coupling further comprises a retainer cap attached to at least one of the motor component or the pump component to cover the interface therebetween and to prevent ingress of debris or contaminates between the motor component and the pump component.

4. The system of claim 1, wherein the motor component has a tapered central bore for receiving the motor shaft.

5. The system of claim 1, wherein the pump and the motor are mounted on separate but aligned weldments.

6. The system of claim 1, wherein the pump and the motor are mounted on a single common weldment.

7. The system of claim 1, further comprising a variable frequency drive monitoring operation of the electric motor.

8. A system for pumping hydraulic fracturing fluid into a wellbore, the system comprising:

a pump having a pump shaft;

an electric motor having a motor shaft, the motor shaft coupling to the pump to drive the pump;

a variable frequency drive and an alternating current console to control the speed of the electric motor to protect against overheating; and a torsional coupling for transmitting energy from the electric motor to the pump, the torsional coupling comprising:

a motor component coupled to the motor shaft;

a pump component coupled to the pump shaft;

the motor component being coupled to the pump component to transmit rotation of the electric motor to the pump, wherein the motor component and the pump component are positioned to enable radial, axial, or angular misalignment when the motor component and the pump component are engaged; and the system further comprising buffers between the motor component and the pump component.

9. The system of claim 8, wherein the torsional coupling further comprises a retainer cap attached to at least one of the motor component or the pump component to cover the interface therebetween and to prevent ingress of debris or contaminates between the motor component and the pump component.

10. The system of claim 8, wherein the motor component has a tapered central bore for receiving the motor shaft.

11. The system of claim 8, wherein the pump and the motor are mounted on separate but aligned weldments.

12. The system of claim 8, further comprising a variable frequency drive monitoring operation of the electric motor.

13. A system for conducting hydraulic fracturing operations in a well, comprising:

hydraulic fracturing equipment having a hydraulic fracturing equipment shaft;

an electric motor with a motor shaft coupled to and driving the hydraulic fracturing equipment;

a variable frequency drive and an alternating current console to control the speed of the electric motor to protect against overheating; and a torsional coupling connecting the motor shaft to the hydraulic fracturing equipment shaft, the torsional coupling comprising:

a motor component coupled to the motor shaft of the electric motor; and a hydraulic fracturing equipment component coupled to the hydraulic fracturing equipment shaft of the hydraulic fracturing equipment, the motor component engaging the hydraulic fracturing equipment component to drive operation of the hydraulic fracturing equipment when the electric motor shaft rotates; and the system further comprising buffers between the hydraulic fracturing equipment component and the motor component.

14. The system of claim 13, wherein the motor component further comprises motor coupling claws and the hydraulic fracturing equipment component further comprises hydraulic fracturing equipment claws, and wherein the motor coupling claws and the hydraulic fracturing equipment claws are spaced to allow at least one of radial, axial, or angular misalignment of the motor component and the hydraulic fracturing equipment component while still allowing engagement of the motor component and the hydraulic fracturing equipment component to transmit torque.

15. The system of claim 13, wherein the torsional coupling further comprises a retainer cap attached to at least one of the motor component or the hydraulic fracturing equipment component to cover the interface therebetween and to prevent ingress of debris or contaminates between the motor component and the hydraulic fracturing equipment component.

16. The system of claim 13, further comprising a variable frequency drive monitoring operation of the electric motor.

* * * * *